US012351960B2

(12) United States Patent
Fujimoto

(10) Patent No.: US 12,351,960 B2
(45) Date of Patent: Jul. 8, 2025

(54) SEWING SYSTEM

(71) Applicant: JUKI CORPORATION, Tama (JP)

(72) Inventor: Mio Fujimoto, Tokyo (JP)

(73) Assignee: JUKI CORPORATION, Tama (JP)

( * ) Notice: Subject to any disclaimer, the term of this patent is extended or adjusted under 35 U.S.C. 154(b) by 0 days.

(21) Appl. No.: 18/519,600

(22) Filed: Nov. 27, 2023

(65) Prior Publication Data

US 2024/0183090 A1 Jun. 6, 2024

(30) Foreign Application Priority Data

Nov. 29, 2022 (JP) ..... 2022-190605

(51) Int. Cl.
*D05B 19/12* (2006.01)
*D05B 19/10* (2006.01)

(52) U.S. Cl.
CPC ..... *D05B 19/12* (2013.01); *D05B 19/10* (2013.01)

(58) Field of Classification Search
CPC . D05C 5/02; D05C 17/00; D05C 7/00; D05C 11/24; D05B 19/12; D05B 67/00; D05B 19/10
See application file for complete search history.

(56) References Cited

U.S. PATENT DOCUMENTS 5,662,055 A * 9/1997 Hartwig ..... G05B 19/0426 112/102.5
5,970,894 A * 10/1999 Mase ..... D05B 19/02 112/102.5
6,196,146 B1 * 3/2001 Goldberg ..... D05B 19/10 705/26.1
6,216,618 B1 * 4/2001 Goldberg ..... D05B 19/105 112/155
6,813,535 B2 * 11/2004 Akira ..... D05B 19/04 112/102.5
6,889,111 B2 * 5/2005 Tomita ..... D05B 19/10 705/26.1
7,685,072 B2 * 3/2010 Hirata ..... H04L 9/0891 700/137
8,276,531 B2 * 10/2012 Tashiro ..... D05C 5/04 112/102.5
8,588,954 B2 * 11/2013 Goldman ..... G06T 11/60 700/138

FOREIGN PATENT DOCUMENTS

JP 2016-214511 A 12/2016
WO WO-2020/230830 A1 11/2020
WO WO-2021/258027 A1 12/2021

OTHER PUBLICATIONS

Extended European Search Report issued Jul. 29, 2024 in Application No. 23212591.4.
Partial European Search Report issued Apr. 10, 2024 in Application No. 23212591.4.

* cited by examiner

*Primary Examiner* — Danny Worrell
(74) *Attorney, Agent, or Firm* — Faegre Drinker Biddle & Reath LLP

(57) ABSTRACT

A sewing system includes an item information acquisition unit that acquires item information including material information indicating information on materials including fabric to be sewn and thread used for sewing, and a sewing information generation unit that generates sewing information based on the item information. The sewing information includes operating conditions of a sewing machine that performs sewing.

15 Claims, 17 Drawing Sheets

Da

| ITEM | PRODUCT NO. | PROCESS | PARTS | FABRIC TYPE | FABRIC THICKNESS | THREAD TYPE | THREAD THICKNESS | ... |
|---|---|---|---|---|---|---|---|---|
| ITEM 1 | PRODUCT NO.1 | PROCESS 1 | PARTS 1, PARTS 2 | XXXX | XXXX | XXXX | XXXX | ... |
| | | PROCESS 2 | PARTS 3 | XXXX | XXXX | XXXX | XXXX | ... |
| | | PROCESS 3 | PARTS 4 | XXXX | XXXX | XXXX | XXXX | ... |
| ... | ... | ... | ... | ... | ... | ... | ... | ... |

FIG.3

FIG.14

De

| ITEM | PRODUCT NO. | PROCESS | SEWING MACHINE | PARTS | FABRIC TYPE | FABRIC THICKNESS | THREAD TYPE | THREAD THICKNESS | ··· |
|---|---|---|---|---|---|---|---|---|---|
| POLO SHIRT | XXX | SEWN PLACKET | AAA~xxxxA | FRONT BODY /PLACKET | xxxx | xxxx | xxxx | xxxx | ··· |
| | | BACK HEM STITCH | BBB | BACK BODY | xxxx | xxxx | xxxx | xxxx | ··· |
| | | SHOULDER SEAM | AAA~xxxxA | FRONT BODY /BACK BODY/TAPE | xxxx | xxxx | xxxx | xxxx | ··· |
| ⋮ | ⋮ | ⋮ | ⋮ | ⋮ | ⋮ | ⋮ | ⋮ | ⋮ | ⋮ |

FIG.17

Df

| ITEM | PRODUCT NO. | PROCESS | SEWING MACHINE | PARTS |
|---|---|---|---|---|
| ITEM 1 | PRODUCT NO. 1 | PROCESS 1 | LOCKSTITCH SEWING 1 | PARTS 1, PARTS 2 |
| | | PROCESS 2 | CYCLE 1 | PARTS 3 |
| | | PROCESS 3 | DIFFERENTIAL FEED 1 | PARTS 3 |
| ⋮ | ⋮ | ⋮ | ⋮ | ⋮ |

FIG.18

Dg

| ITEM | PRODUCT NO. | PROCESS | SEWING MACHINE | PARTS | GRAPHIC INFORMATION | SEWING INFORMATION |
|---|---|---|---|---|---|---|
| ITEM 1 | PRODUCT NO. 1 | PROCESS 1 | LOCKSTITCH SEWING 1 | PARTS 1, PARTS 2 | – | yyyy–0001.XLS |
| | | PROCESS 2 | CYCLE 1 | PARTS 3 | xxxx–0001.DXF | yyyy–0002.XLS |
| | | PROCESS 3 | DIFFERENTIAL FEED 1 | PARTS 3 | xxxx–0001.DXF | yyyy–0003.XLS |
| ⋮ | ⋮ | ⋮ | ⋮ | ⋮ | ⋮ | ⋮ |

SEWING SYSTEM

CROSS-REFERENCE TO RELATED APPLICATIONS

This application is based on and claims priority under 35 USC 119 from Japanese Patent Application No. 2022-190605 filed on Nov. 29, 2022.

TECHNICAL FIELD

The present disclosure relates to a sewing system.

BACKGROUND ART

In the technical field related to sewing machines, a sewing machine management system as disclosed in JP2016-214511A is known.

SUMMARY OF INVENTION

Producing one sewn product requires a plurality of processes, and in the related art, generation of data such as sewing patterns and operation settings are manually performed for each sewing machine used in each process. Even when performing the same process on a plurality of sewing machines, data should be created and operation settings should be made for each machine, which is time consuming and complicated.

An object of the present disclosure is to reduce the number of man-hours involved in preparing for sewing with the sewing machine.

An aspect of the present invention is a sewing system that includes an item information acquisition unit that acquires item information including material information indicating information on materials including fabric to be sewn and thread used for sewing, and a sewing information generation unit that generates sewing information based on the item information. The sewing information includes operating conditions of a sewing machine that performs sewing.

According to the aspect of the present disclosure, it is possible to reduce the number of man-hours required for preparation for sewing with a sewing machine.

BRIEF DESCRIPTION OF DRAWINGS

FIG. 3 is a diagram showing an example of information included in item information shown in FIG. 1;

FIG. 14 is a diagram showing an example of information included in the item information shown in FIG. 8;

FIG. 17 is a diagram showing an example of information included in process list information shown in FIG. 15;

FIG. 18 is a diagram showing an example of information included in item information correspondence table shown in FIG. 15;

DESCRIPTION OF EMBODIMENTS

Embodiments according to the present disclosure will be described below with reference to the drawings, but the present disclosure is not limited thereto. The components of the embodiments described below can be combined as appropriate. Furthermore, some components may not be used.

First Embodiment

<Sewing System>

Figure 1:
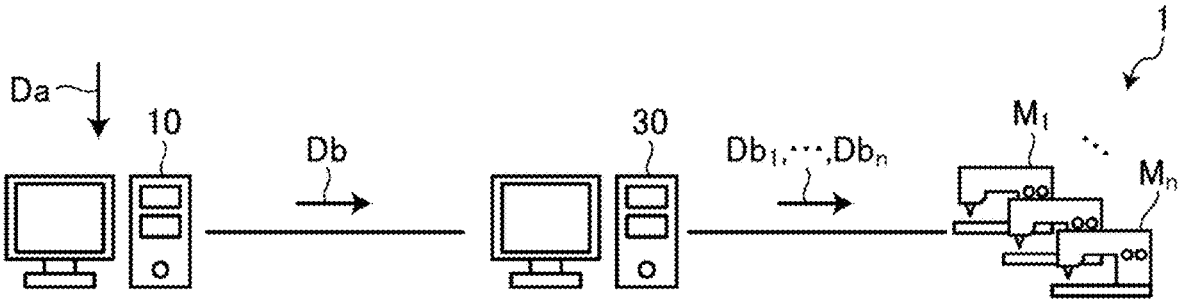
FIG. 1 is a diagram schematically showing a sewing system according to a first embodiment.

FIG. 1 is a diagram schematically showing a sewing system 1 according to a first embodiment. As shown in FIG. 1, the sewing system 1 includes a sewing information generation apparatus 10, a management apparatus 30, and a plurality of sewing machines $M_1, \ldots, M_n$ (referred to as the sewing machine M unless otherwise distinguished). The sewing information generation apparatus 10, the management apparatus 30, and the sewing machine M are communicably connected via a communication network NW (see FIG. 2) using short-range wireless communication such as Bluetooth (registered trademark) or wireless LAN (Local Area Network), or wired communication.

The sewing system 1 is installed in a sewing factory, which is an operating facility where a plurality of sewing machines M are operated, for example. In the sewing factory, sewn products are manufactured by stitching workpiece with sewing thread using the sewing machine M. In a sewing factory, a plurality of or one operator and one or more managers work. The operator operates the sewing machine M to perform a sewing process. The manager manages the operators and the sewing machines M. The operator or the manager operates the sewing information generation apparatus 10 to create sewing information Db for each sewing machine M to perform the sewing process. The manager operates the management apparatus 30 to check and manage the status of the sewing process in the sewing factory.

The sewing information generation apparatus 10 is an information terminal that is operated by the operator or the manager to generate the sewing information Db based on acquired item information Da and output the generated information to the management apparatus 30. As a typical example of the sewing information generation apparatus 10, a desktop personal computer (PC) or a notebook PC is assumed, but it may also be implemented by a smartphone, a tablet terminal, a mobile phone, a personal digital assistant (PDA), and the like. The sewing information generation apparatus 10 is installed in an office section of the sewing factory, for example.

The item information Da is data including process information and sewing information in each process. The process information includes the type and product number of an item to be produced, a plurality of processes for producing the item, parts to be sewn used in each process, and the like. For example, the type of item refers to the type of sewn product, such as a polo shirt, dress shirt, jacket, skirt, and the like.

The process refers to steps of work related to sewing, such as placket sewing, back hem sewing, pattern matching sewing, and the like, in which the process to produce one sewn product is divided in accordance with the sewing area and the function of the sewing machine used. The parts to be sewn refer to each of cut fabrics such as a front body, a back body, and a placket, buttons, tape, and the like in a state before being sewn together, for example.

The sewing information includes material information such as the fabric to be sewn, buttons, tape, and thread used. The information on fabric includes the type, thickness, stretching rate, and the like, for example. The information on thread includes type, thickness, and the like, for example. The information on button includes the type, size, number and position of holes, and the like, for example. The information on tape includes type, thickness, width, and the like, for example.

The sewing information Db is data that includes process information, and sewing machine information that is information on the sewing machine M that performs each process. The process information overlaps in content with the process information of the item information Da. The sewing machine information includes a model type of the sewing machine M that performs each process, and operating conditions of the sewing machine M including set values for operating the sewing machine M. When the sewing machine M is a lockstitch sewing machine, the set values include a stitch length (an amount of movement per stitch), a number of stitches, thread tension, presser pressure, fabric feed speed, and the like, for example. The sewing information Db is generated by the sewing information generation apparatus 10 and output to the management apparatus 30. The sewing information Db is distributed to sewing information $Db_1, \ldots, Db_n$ corresponding to respective sewing machines $M_1, \ldots, M_n$ in the management apparatus 30.

The management apparatus 30 is an information terminal that is operated by the manager to acquire the sewing information Db output from the sewing information generation apparatus 10, distribute the acquired information to each sewing machine M, and transmit the information. As a typical example of the management apparatus 30, a desktop PC or a notebook PC is assumed, but it may also be implemented by a smartphone, a tablet terminal, a mobile phone, a PDA, and the like. The sewing information generation apparatus 10 is installed in an office section of the sewing factory, for example.

The sewing machine M is an industrial sewing machine operated by the operator. For example, the industrial sewing machines include lockstitch-type sewing machines that perform lockstitching, cycle sewing machines, differential feed sewing machines, button sewing machines, and the like, and in the first embodiment, a lockstitch-type sewing machine is assumed. Each of the sewing machines $M_1, \ldots, M_n$ acquires corresponding sewing information $Db_1, \ldots, Db_n$ (unless specifically distinguished, this will be referred to as the sewing information Db) from the management apparatus 30. The operator sets the operating conditions of the sewing machine M and also performs a predetermined sewing process according to the sewing information Db transmitted to the sewing machine M. The sewing machine M may automatically set the operating conditions based on the acquired sewing information Db. With the workpiece and the sewing thread set in predetermined positions, the sewing machine M starts a predetermined sewing process as the operator performs a predetermined operation.

<Sewing Information Generation Apparatus and Management Apparatus>

Figure 2:
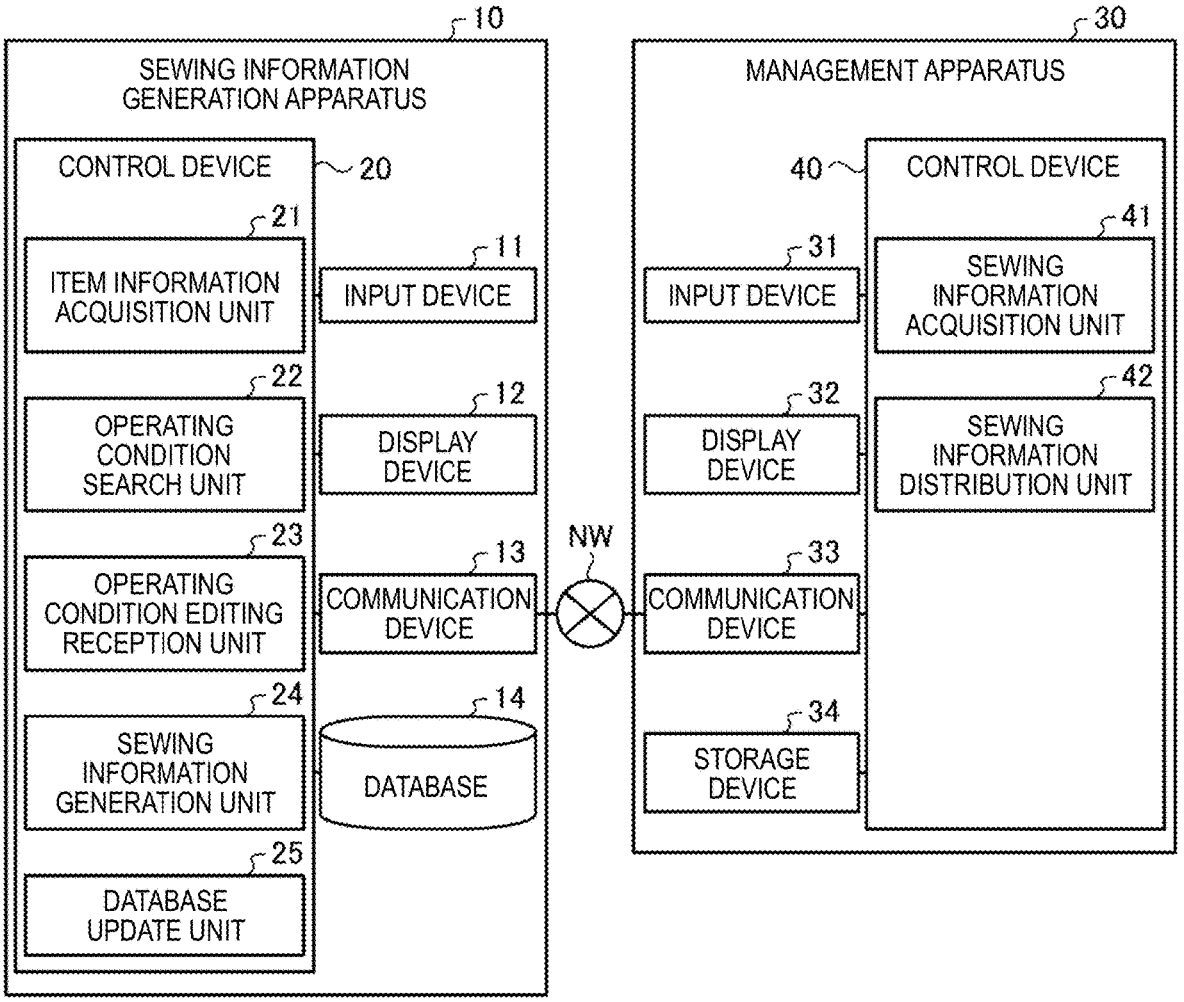
FIG. 2 is a functional block diagram showing a sewing information generation apparatus and a management apparatus according to the first embodiment.

FIG. 2 is a functional block diagram showing the sewing information generation apparatus 10 and the management apparatus 30 according to the first embodiment.

As shown in FIG. 2, the sewing information generation apparatus 10 includes an input device 11, a display device 12, a communication device 13, a database 14, and a control device 20.

The input device 11 receives various input operations by the operator or the manager. The input device 11 is operated to generate the input data. The input device 11 is implemented by a keyboard, a mouse, operation keys, a microphone that receives voice input, or the like, for example. When the sewing information generation apparatus 10 is a smartphone or a tablet terminal, the input device 11 may be an operation panel including a touch sensor arranged on a display screen of the display device 12, for example.

The display device 12 displays various information. The display device 12 includes a flat panel display such as a liquid crystal display (LCD) or an organic electroluminescence display (OELD), for example.

The communication device 13 communicates with the management apparatus 30 via the communication network NW. The communication device 13 transmits the sewing information Db to the management apparatus 30.

The database 14 is implemented by a primary storage device that is a volatile memory such as Random Access Memory (RAM), and a secondary storage device that is a non-volatile memory such as Read Only Memory (ROM), Hard Disk Drive (HDD), Solid State Drive (SSD), storage, and the like.

The database 14 accumulates and stores correspondence information in which material information including fabrics and threads and the operating conditions of the sewing machine M including the model type of the sewing machine M and the set values are associated with each other.

The control device 20 includes a computer system that includes an arithmetic processing device as an operation means, a storage device as a storage means, and an input and output interface device, and executes various controls in each unit of the sewing information generation apparatus 10. The arithmetic processing device includes a processor such as a Central Processing Unit (CPU) or an Micro Processing Unit (MPU), for example. For example, the storage device includes a primary storage device such as RAM, which is a volatile memory that temporarily stores data, and a secondary storage device such as ROM, HDD, SSD, or a storage, which is a non-volatile memory that stores various programs and various data used by the arithmetic processing device for calculations. The arithmetic processing device performs various calculations based on a predetermined program stored in the storage device. The arithmetic processing device outputs various control signals to each unit via the input and output interface device according to the arithmetic results. The control device 20 includes an item information acquisition unit 21, an operating condition search unit 22, an operating condition editing reception unit 23, a sewing information generation unit 24, and a database update unit 25.

The item information acquisition unit 21 acquires the item information Da input from the input device 11 by the operator or the manager. Once input, the item information Da can be edited as appropriate. That is, part or all of the contents of the item information Da can be edited based on information input from the input device 11 by the operator or the manager. The item information acquisition unit 21 outputs the acquired item information Da to the operating condition search unit 22.

FIG. 3 is a diagram showing an example of information included in the item information Da shown in FIG. 1. As shown in FIG. 3, the item information Da of the first embodiment includes information in which "item", "product number", "process", "parts", "fabric type", "fabric thickness", "thread type", "thread thickness", and the like are associated with each other for each process.

The "item" is information on the type of item to be produced. The "product number" is information on a number that identifies the item to be produced. The "process" is information including a name or an identifier indicating each process for producing the item. The "parts" is information on parts to be sewn that are used in each process. The "fabric type" is information on the type of fabric of the parts to be sewn used in each process. The "fabric thickness" is information on the thickness of the fabric of the parts to be sewn used in each process. The "thread type" is information on the type of thread used for sewing in each process. The "thread thickness" is information on the thickness of thread used for sewing in each process.

The operating condition search unit 22 searches for and acquires the operating condition of the sewing machine M that corresponds to the search condition by referring to the correspondence information stored in the database 14. The search conditions include material information including fabrics and threads in each process included in the acquired item information Da. If the database 14 does not store the correspondence information corresponding to a condition that completely matches the search condition, the operating condition search unit 22 may search for and acquire the operating condition of the sewing machine M that corresponds to the approximate search condition.

The operating condition editing reception unit 23 receives the input data input from the input device 11 by the operator or the manager to edit the operating conditions of the sewing machine M. Editing the operating conditions of the sewing machine M is useful when, for example, the search conditions searched by the operating condition search unit 22 are not stored in the database 14 and the operating conditions of the sewing machine M corresponding to the approximate search conditions are acquired.

The sewing information generation unit 24 generates the sewing information Db based on the item information Da acquired by the item information acquisition unit 21 and the operating conditions of the sewing machine M of the correspondence information acquired by the operating condition search unit 22. When the operating condition editing reception unit 23 receives editing of the operating conditions of the sewing machine M, the sewing information generation unit 24 generates the sewing information Db that reflects the updated operating conditions of the sewing machine M. For example, the sewing information generation unit 24 outputs the generated sewing information Db to the display device 12 for display. For example, when the operator or the manager confirms the displayed sewing information Db and performs a predetermined operation using the input device 11, the sewing information generation unit 24 stores the generated sewing information Db in the storage device. For example, when the operator or the manager performs a predetermined operation using the input device 11, the sewing information generation unit 24 outputs a control signal to the communication device 13 to transmit the generated sewing information Db to the management apparatus 30. The sewing information Db is transmitted to the management apparatus 30 by the communication device 13.

When the operating condition editing reception unit 23 edits the operating conditions of the sewing machine M corresponding to predetermined material information, the database update unit 25 updates the operating conditions of the sewing machine M corresponding to the material information with respect to the correspondence information stored in the database 14. The correspondence information in the database 14 may be updated based on the edited operating conditions of the sewing machine M only when the operator or the manager performs a predetermined operation using the input device 11.

The management apparatus 30 includes an input device 31, a display device 32, a communication device 33, a storage device 34, and a control device 40.

The input device 31 receives various input operations by the manager. The input device 31 is operated to generate the input data. The input device 31 is implemented by a keyboard, a mouse, operation keys, a microphone that receives voice input, or the like, for example. When the management apparatus 30 is a smartphone or a tablet terminal, the input device 31 may be an operation panel including a touch sensor arranged on a display screen of the display device 32, for example.

The display device 32 displays various information. The display device 32 includes a flat panel display such as a liquid crystal display or an organic EL display, for example.

The communication device 33 communicates with the sewing information generation apparatus 10 and the sewing machine M via the communication network NW. The communication device 33 receives the sewing information Db transmitted from the sewing information generation apparatus 10. The communication device 33 transmits the sewing information $Db_1, \ldots, Db_n$, distributed corresponding to each sewing machine $M_1, \ldots, M_n$, to each sewing machine $M_1, \ldots, M_n$.

The storage device 34 is implemented by a primary storage device that is a volatile memory such as RAM, and a secondary storage device that is a nonvolatile memory such as ROM, or HDD, SSD, or a storage. The storage device 34 stores information on sewing machines $M_1, \ldots, M_n$, for example. The information on sewing machines M includes the model type of the sewing machine M, an identification number, information on the operator who operates the sewing machine M, and the like, for example.

The control device 40 includes a computer system including an arithmetic processing device as an operation means, a storage device as a storage means, and an input and output interface device, and executes various controls in each unit of the management apparatus 30. The arithmetic processing device includes a processor such as a CPU or MPU, for example.

For example, the storage device includes a primary storage device such as RAM, which is a volatile memory that temporarily stores data, and a secondary storage device such as ROM, HDD, SSD, or a storage, which is a non-volatile memory that stores various programs and various data used by the arithmetic processing device for calculations. The arithmetic processing device performs various calculations based on a predetermined program stored in the storage device. The arithmetic processing device outputs various control signals to each unit via the input and output interface device according to the arithmetic results. The control device 40 includes a sewing information acquisition unit 41 and a sewing information distribution unit 42.

The sewing information acquisition unit 41 acquires the sewing information Db received from the sewing information generation apparatus 10 by the communication device 33.

The sewing information distribution unit 42 distributes the sewing information Db acquired by the sewing information acquisition unit 41 to each sewing machine $M_1, \ldots, M_n$. Specifically, the sewing information distribution unit 42 generates the sewing information $Db_1, \ldots, Db_n$ corresponding to each sewing machine $M_1, \ldots, M_n$ by dividing it from the sewing information Db based on the information of each sewing machine $M_1, \ldots, M_n$ stored in the storage device 34. The sewing information distribution unit 42 outputs a control signal to the communication device 33 to transmit the generated sewing information $Db_1, \ldots, Db_n$ to the corresponding sewing machines $M_1, \ldots, M_n$. The sewing information $Db_1, \ldots, Db_n$ is transmitted to each sewing machine $M_1, \ldots, M_n$ by the communication device 33. The sewing information distribution unit 42 may output a control signal to the communication device 33 to store the generated sewing information $Db_1, \ldots, Db_n$ in the storage device and transmit the stored information to the corresponding sewing machines $M_1, \ldots, M_n$ when the operator or the manager performs a predetermined operation using the input device 31.

<Sewing Management Method>

Figure 4:
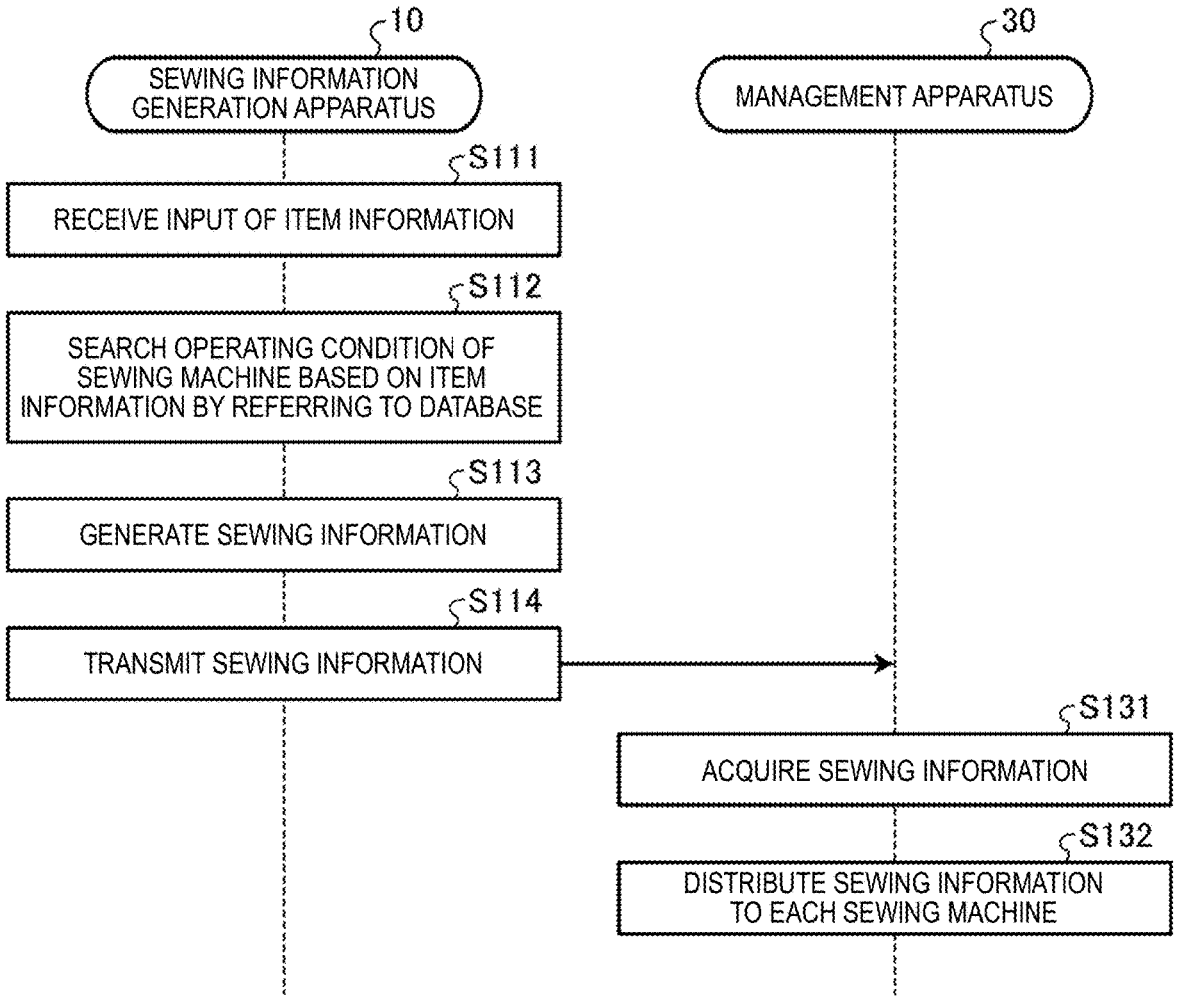
FIG. 4 is a flowchart showing an operation of the sewing system according to the first embodiment.

FIG. 4 is a flowchart showing an operation of the sewing system 1 according to the first embodiment. The processes from steps S111 to S115 shown in FIG. 4 are executed by the sewing information generation apparatus 10 based on a predetermined program and data. The processes from steps S131 to S132 are executed by the management apparatus 30 based on a predetermined program and data.

The operator or the manager operates the input device 11 of the sewing information generation apparatus 10 to input the item information Da. The item information acquisition unit 21 of the sewing information generation apparatus 10 acquires the item information Da input from the input device 11 (step S111).

The operating condition search unit 22 of the sewing information generation apparatus 10 searches for and acquires the operating conditions of the sewing machine M based on the item information Da by referring to the correspondence information between the material information and the operating conditions of the sewing machine M accumulated in the database 14 (step S112). At this time, the search conditions include the material information included in the item information Da. In addition, if the database 14 does not store the correspondence information corresponding to a condition that completely matches the search condition, the operating condition search unit 22 searches for and acquires the operating condition of the sewing machine M that corresponds to the approximate search condition.

Here, the operator or the manager may operate the input device 11 of the sewing information generation apparatus 10 to edit the operating conditions searched by the operating condition search unit 22. The operating condition editing reception unit 23 of the sewing information generation apparatus 10 receives and changes the editing of the operating conditions input from the input device 11. Further, when the operating condition editing reception unit 23 receives the editing of operating conditions, the database update unit 25 may update the correspondence information stored in the database 14.

The sewing information generation unit 24 of the sewing information generation apparatus 10 generates the sewing information Db including the item information Da and the operating conditions of the sewing machine M corresponding to the material information (step S113). For example, the sewing information generation unit 24 outputs the generated sewing information Db to the display device 12 for display. When the operator or the manager confirms the displayed sewing information Db and performs a predetermined operation using the input device 11, the sewing information generation unit 24 stores the generated sewing information Db in the storage device.

The sewing information generation apparatus 10 transmits the sewing information Db to the management apparatus 30 (step S114). Specifically, for example, when the operator or the manager performs a predetermined operation using the input device 11, the sewing information generation unit 24 outputs a control signal to the communication device 13 to transmit the generated sewing information Db to the management apparatus 30. The sewing information Db is transmitted to the management apparatus 30 by the communication device 13.

The communication device 33 of the management apparatus 30 receives the sewing information Db transmitted from the sewing information generation apparatus 10. The sewing information acquisition unit 41 of the management apparatus 30 acquires the sewing information Db received by the communication device 33 (step S131).

The sewing information distribution unit 42 of the management apparatus 30 distributes the sewing information Db to each sewing machine $M_1, \ldots, M_n$ (step S132). Specifically, the sewing information distribution unit 42 generates the sewing information $Db_1, \ldots, Db_n$ corresponding to each sewing machine $M_1, \ldots, M_n$ by dividing it from the sewing information Db based on the information of each sewing machine $M_1, \ldots, M_n$ stored in the storage device 34. The sewing information distribution unit 42 outputs a control signal to the communication device 33 to transmit the generated sewing information $Db_1, \ldots, Db_n$ to the corresponding sewing machines $M_1, \ldots, M_n$. The sewing information $Db_1, \ldots, Db_n$ is transmitted to each sewing machine $M_1, \ldots, M_n$ by the communication device 33.

<Effects>

As described above, according to the first embodiment, the sewing information Db that includes operating conditions of the sewing machine M that performs sewing can be generated based on the item information Da that includes that material information that indicates information on the materials including fabric to be sewn and thread used for sewing. Further, according to the first embodiment, by referring to the database 14 that accumulates the correspondence information in which material information and operating conditions of the sewing machine M are associated with each other, the operating conditions of the sewing machine M based on the item information Da are presented, and the sewing information Db is generated based on the same. Accordingly, when adjusting the set values of the sewing machine M for each sewing process, the settings can be made according to the sewing information Db, so that the process related to preparation for sewing by the sewing machine M can be shortened.

The information regarding the operating conditions of the sewing machine M presented from the database 14 can be edited. The database 14 can be updated based on the edited operating conditions of the sewing machine M. Accordingly, the accuracy of the correspondence information accumulated in the database 14 between the material information and the operating conditions of the sewing machine M can be improved.

Further, according to the first embodiment, when a plurality of sewing machines M are used to produce a sewn product, the sewing information Db can be distributed to each sewing machine M.

Second Embodiment

<Sewing System>

Figure 5:
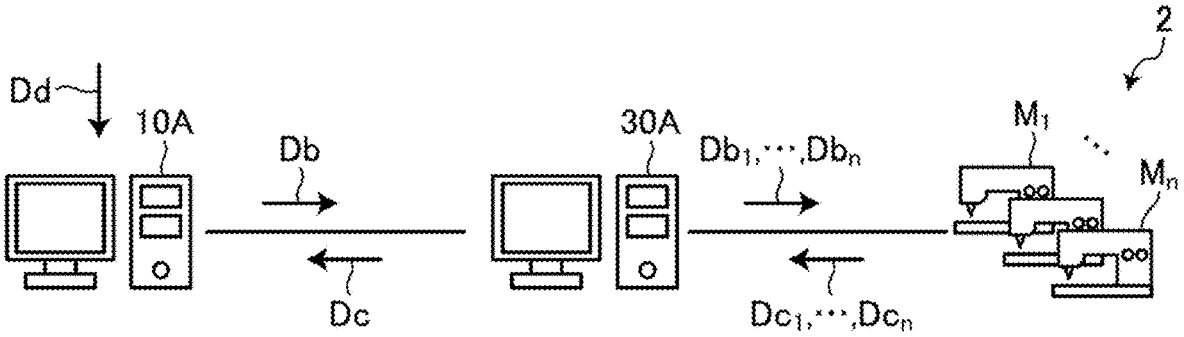
FIG. 5 is a diagram schematically showing a sewing system according to a second embodiment.

FIG. 5 is a diagram schematically showing a sewing system 2 according to a second embodiment. In the sewing system 2 of the second embodiment, the same configurations as those of the sewing system 1 of the first embodiment are given the same reference numerals, and the description thereof will be omitted as appropriate, while different configurations, functions, and operations will be described. As shown in FIG. 5, the sewing system 2 includes a sewing information generation apparatus 10A, a management apparatus 30A, and a plurality of sewing machines M. The sewing system 2 differs from the sewing system 1 of the first embodiment in that the sewing information generation apparatus 10A acquires feedback information Dc from the sewing machine M via the management apparatus 30A.

The feedback information Dc is data that is output from the sewing machine M and includes information on content of the change when actual settings are changed in the sewing information Db during sewing process by sewing machine M. The set values of each sewing machine $M_1, \ldots, M_n$ are adjusted based on the sewing information $Db_1, \ldots, Db_n$ generated by the sewing information generation apparatus 10A and distributed to the management apparatus 30A. When sewing with the sewing machine M adjusted to the set values, if a problem occurs in the sewing process, such as stitches pulling, skipping, getting tangled, the needle not sticking easily, or poor feed, and the like, the operator operating the sewing machine M finely adjusts the set values and tries again. The sewing machine M associates the finely adjusted set values with the original sewing information Db and outputs the result as the feedback information Dc.

Each of the sewing machines $M_1, \ldots, M_n$ transmits the feedback information Dc1, . . . , Dcn to the management apparatus 30A. The management apparatus 30A receives the feedback information Dc1, . . . , Dcn from each of the sewing machines $M_1, \ldots, M_n$. The management apparatus 30A transmits the acquired feedback information Dc1, . . . , Dcn to the sewing information generation apparatus 10A as the feedback information Dc associated with each type of sewing machine $M_1, \ldots, M_n$. The sewing information generation apparatus 10A receives the feedback information Dc from the management apparatus 30A.

<Sewing Information Generation Apparatus and Management Apparatus>

Figure 6:
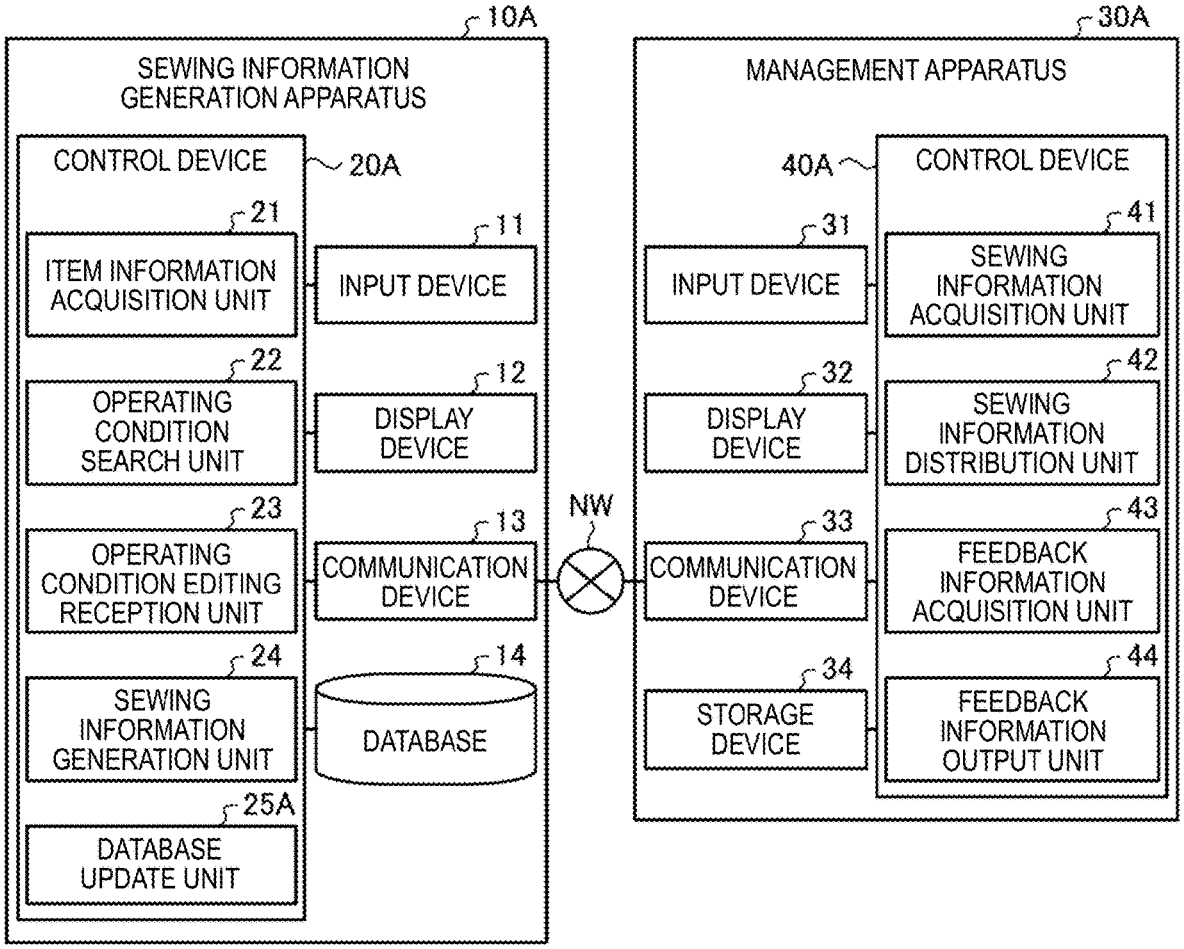
FIG. 6 is a functional block diagram showing a sewing information generation apparatus and a management apparatus according to the second embodiment.

FIG. 6 is a functional block diagram showing the sewing information generation apparatus 10A and the management apparatus 30A according to a second embodiment. In the sewing information generation apparatus 10A and the management apparatus 30A of the second embodiment, the same configurations as the sewing information generation apparatus 10 and the management apparatus 30 of the first embodiment are given the same reference numerals, and the description thereof will be omitted as appropriate, while different configurations, functions, and operations will be described.

As shown in FIG. 6, the management apparatus 30A includes the input device 31, the display device 32, the communication device 33, the storage device 34, and a control device 40A. Further, the control device 40A includes the sewing information acquisition unit 41, the sewing information distribution unit 42, a feedback information acquisition unit 43, and a feedback information output unit 44. That is, the management apparatus 30A is different from the management apparatus 30 of the first embodiment in that the control device 40A includes the feedback information acquisition unit 43 and the feedback information output unit 44.

The feedback information acquisition unit 43 acquires the feedback information Dc1, . . . , Dcn received from each of the sewing machines $M_1, \ldots, M_n$ by the communication device 13.

The feedback information output unit 44 generates the feedback information Dc obtained by integrating the feedback information Dc1, . . . , Dcn acquired by the feedback information acquisition unit 43. The feedback information output unit 44 outputs a control signal to the communication device 33 to transmit the generated feedback information Dc to the sewing information generation apparatus 10A. The feedback information Dc is transmitted to the sewing information generation apparatus 10A by the communication device 33. When the feedback information acquisition unit 43 acquires the feedback information Dc1, . . . , Dcn, the feedback information output unit 44 may output the feedback information Dc each time, or may output the feedback information Dc when the manager performs a predetermined operation using the input device 31, for example. Further, the feedback information output unit 44 may output a control signal to the communication device 33 to store the generated feedback information Dc in the storage device and transmit the stored information to the sewing information generation apparatus 10A when the operator or the manager performs a predetermined operation using the input device 31.

The sewing information generation apparatus 10A includes the input device 11, the display device 12, the communication device 13, the database 14, and a control device 20A. The control device 20A also includes the item information acquisition unit 21, the operating condition search unit 22, the operating condition editing reception unit 23, the sewing information generation unit 24, and a database update unit 25A. In the sewing information generation apparatus 10A, the database update unit 25A of the control device 20A has a different function from the database update unit 25 of the first embodiment.

In addition to the functions of the database update unit 25 of the first embodiment, the database update unit 25A has a function of updating the correspondence information in the database 14 based on the feedback information Dc received from the management apparatus 30A by the communication device 13. That is, when the operator of the sewing machine M changes the operating conditions of the sewing machine M with respect to the sewing information Db, the database update unit 25A updates the operating conditions of the sewing machine M corresponding to the material information with respect to the correspondence information stored in the database 14. The correspondence information in the database 14 may be updated based on the feedback information Dc only when the operator or the manager performs a predetermined operation using the input device 11.

<Sewing Management Method>

Figure 7:
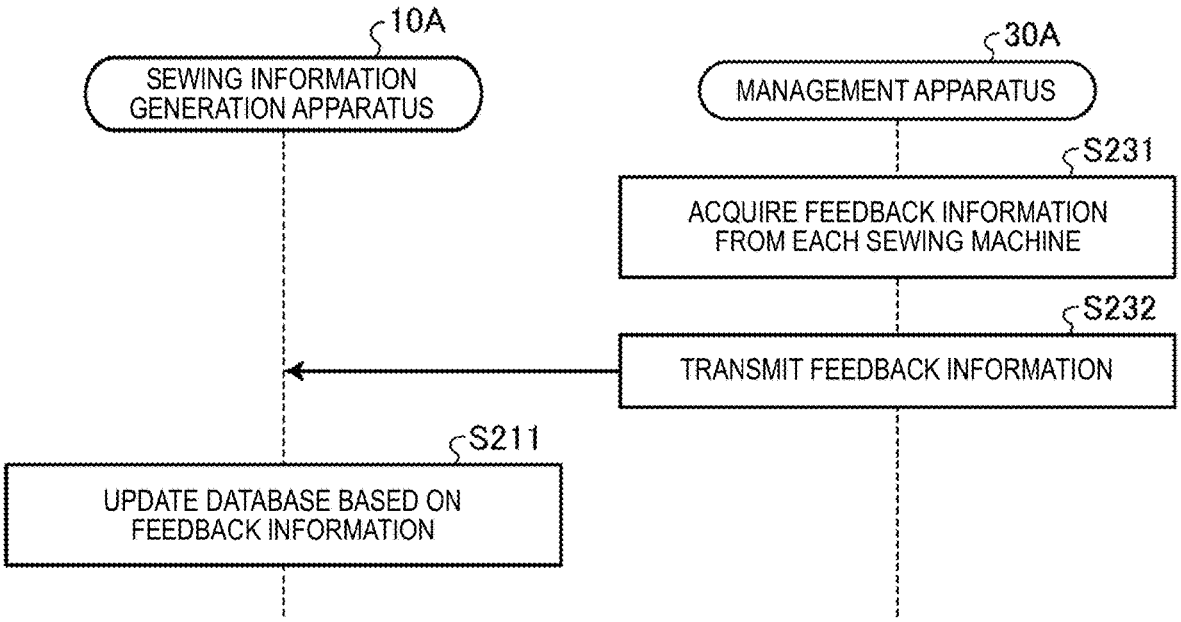
FIG. 7 is a flowchart showing an operation of the sewing system according to the second embodiment.

FIG. 7 is a flowchart showing the operation of the sewing system 2 according to the second embodiment. The process of step S211 shown in FIG. 7 is executed by the sewing information generation apparatus 10A based on a predetermined program and data. The processes from steps S231 to S233 are executed by the management apparatus 30A based on a predetermined program and data.

The operating conditions of each sewing machine $M_1, \ldots, M_n$ are set based on the sewing information $Db_1, \ldots, Db_n$ received from the management apparatus 30. The operator of the sewing machine M performs sewing process according to the operating conditions. If a problem occurs in the sewing process, the operator finely adjusts the set values of the sewing machine M and tries again. The sewing machine M associates the finely adjusted set values with the original sewing information Db and outputs the result as feedback information Dc.

The communication device 33 of the management apparatus 30 receives the feedback information Dc1, . . . , Dcn from each sewing machine $M_1, \ldots, M_n$. The feedback information acquisition unit 43 of the management apparatus 30 acquires the feedback information Dc1, . . . , Dcn received by the communication device 33 (step S231).

The feedback information output unit 44 generates feedback information Dc obtained by integrating the feedback information Dc1, . . . , Dcn acquired by the feedback information acquisition unit 43. The feedback information output unit 44 outputs a control signal to the communication device 33 to transmit the generated feedback information Dc to the sewing information generation apparatus 10A. The feedback information Dc is transmitted to the sewing information generation apparatus 10A by the communication device 33 (step S232).

The communication device 13 of the sewing information generation apparatus 10A receives the feedback information Dc. The database update unit 25A acquires the feedback information Dc. The database update unit 25A updates the operating conditions of the sewing machine M corresponding to the material information with respect to the correspondence information stored in the database 14 based on the acquired feedback information Dc (step S211).

<Effects>

As described above, according to the second embodiment, in the sewing machine M that performed sewing under the operating conditions based on the sewing information Db, the correspondence information stored in the database 14 can be updated based on the feedback information Dc output from the sewing machine M when the operating conditions are changed. Accordingly, the accuracy of the correspondence information accumulated in the database 14 between the material information and the operating conditions of the sewing machine M can be improved.

Third Embodiment

<Sewing System>

Figure 8:
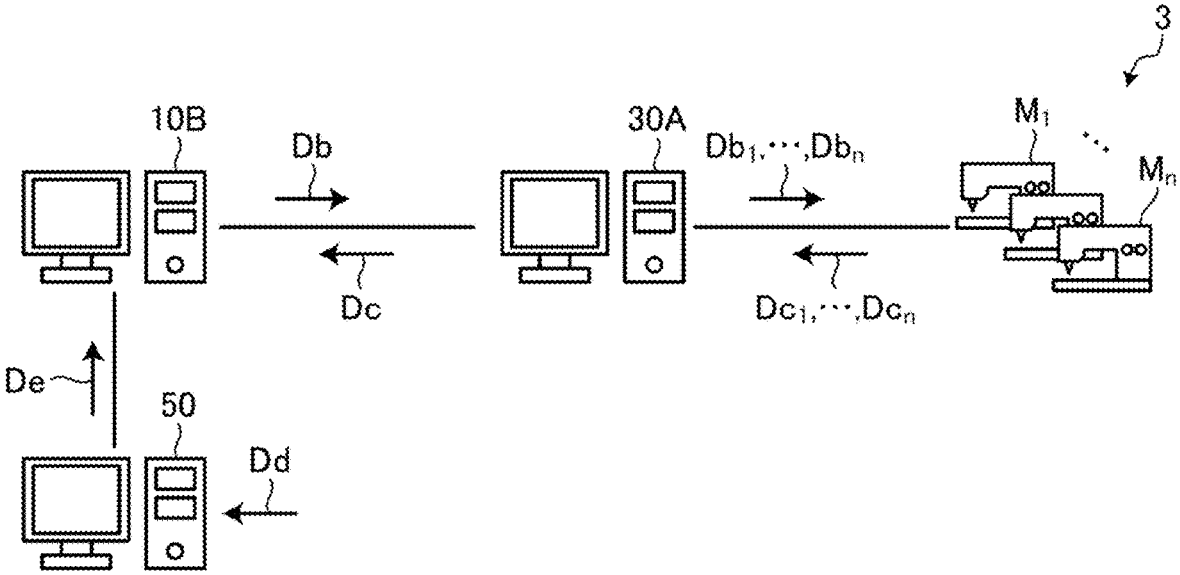
FIG. 8 is a diagram schematically showing a sewing system according to a third embodiment.

FIG. 8 is a diagram schematically showing a sewing system 3 according to a third embodiment. In the sewing system 3 of the third embodiment, the same configurations as the sewing system 1 of the first embodiment and the sewing system 2 of the second embodiment are given the same reference numerals, and the description thereof will be omitted as appropriate, while different configurations, functions, and operations will be described. As shown in FIG. 8, the sewing system 3 includes a sewing information generation apparatus 10B, the management apparatus 30A, a process information generation apparatus 50, and a plurality of sewing machines M. The sewing system 3 is different from the sewing system 2 of the second embodiment in that, instead of inputting item information Da to the sewing information generation apparatus 10A, the process information generation apparatus 50 input with item basic information Dd outputs item information De.

The item basic information Dd is data including information such as the type of item to be produced, the type of fabric and thread, and so on. The item basic information Dd may include option information corresponding to the type of item. The option information is information regarding the presence or absence of parts that can be selectively added to the item, such as sleeve ribs, chest pockets, hem slits, and sleeve pockets, for example.

The item information De is data that includes process information, sewing machine model information that is information on the model type of the sewing machine M that performs each process, and sewing information in each process. The process information includes the type and product number of the item to be produced, a plurality of processes for producing the item, parts to be sewn used in each process, and the like. That is, the item information De is data obtained by adding the sewing machine model information, which is information on the model type of the sewing machine M that performs each process, to the item information Da of the first and the second embodiments. Furthermore, while the item information Da in the first and second embodiments is manually input by the operator or the manager, the item information De in the third embodiment is generated by the process information generation apparatus 50. It is to be noted that the sewing information is manually input in a supplementary manner by the operator or the manager.

The process information generation apparatus 50 is an information terminal that is operated by the operator or the manager to generate a process list based on the input item basic information Dd, and to output the item information De in which the sewing information is input to the process list in a supplementary manner. As a typical example of the process information generation apparatus 50, a desktop PC or a notebook PC is assumed, but it may also be implemented by a smartphone, a tablet terminal, a mobile phone, a PDA, or the like. The process information generation apparatus 50 is installed in the office section of the sewing factory, for example.

<Sewing Information Generation Apparatus, Management Apparatus, and Process Information Generation Apparatus>

Figure 9:
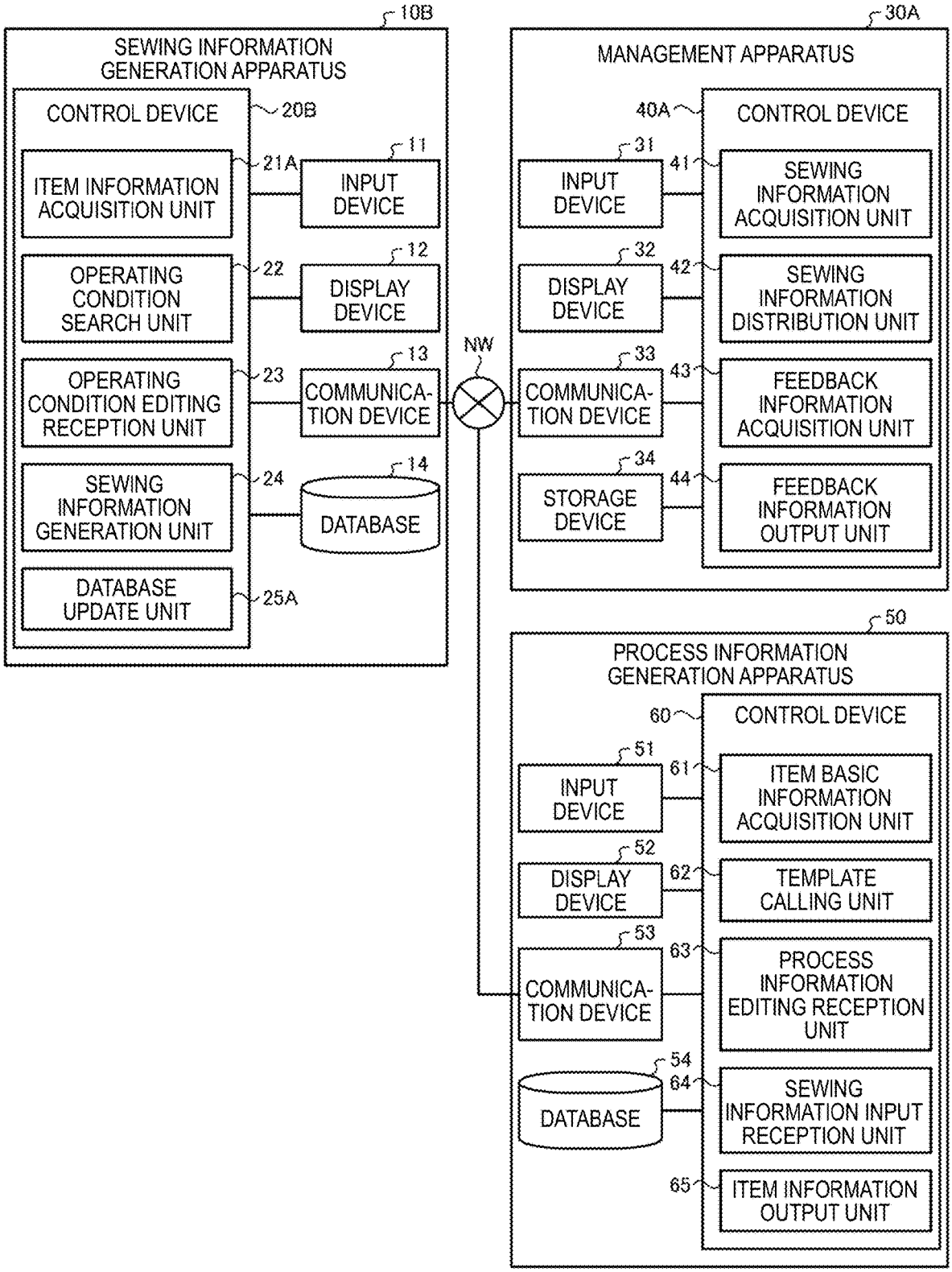
FIG. 9 is a functional block diagram showing a sewing information generation apparatus, a management apparatus, and a process information generation apparatus according to the third embodiment.

FIG. 9 is a functional block diagram showing the sewing information generation apparatus 10B, the management apparatus 30A, and the process information generation apparatus 50 according to the third embodiment. As shown in FIG. 9, the process information generation apparatus 50 includes an input device 51, a display device 52, a communication device 53, a database 54, and a control device 60.

The input device 51 receives various input operations by the operator or the manager. The input device 51 is operated to generate the input data. The input device 51 is implemented by a keyboard, a mouse, operation keys, a microphone that receives voice input, or the like, for example. When the process information generation apparatus 50 is a smartphone or a tablet terminal, the input device 51 may be an operation panel including a touch sensor arranged on the display screen of the display device 52, for example.

The display device 52 displays various information. The display device 52 includes a flat panel display such as a liquid crystal display or an organic EL display, for example.

The communication device 53 communicates with the sewing information generation apparatus 10B via the communication network NW. The communication device 53 transmits the item information De to the sewing information generation apparatus 10B.

The database 54 is implemented by a primary storage device that is a volatile memory such as RAM, and a secondary storage device that is a nonvolatile memory such as ROM, or HDD, SSD, or a storage. The database 54 accumulates and stores a plurality of templates associated with item basic information Dd including information such as the type of item to be produced, the type of fabric and thread, options, and the like.

The templates include a process list corresponding to the item basic information Dd. The process list is a table in which items related to the process information are arranged in the order in which a plurality of processes are performed. In the process list of each template, recommended processes for generating the item included in the item basic information Dd are arranged, and the process information (parts of workpiece in the process, and the like) corresponding to the combination of items included in the item basic information Dd and model information of the sewing machine M that executes the process are input in advance for each process (see a display area 52*k* in FIG. 13 described below).

The control device 60 includes a computer system including an arithmetic processing device as an operation means, a storage device as a storage means, and an input and output interface device, and executes various controls in each unit of the process information generation apparatus 50. The arithmetic processing device includes a processor such as a CPU or MPU, for example. For example, the storage device includes a primary storage device such as RAM, which is a volatile memory that temporarily stores data, and a secondary storage device such as ROM, HDD, SSD, or a storage, which is a non-volatile memory that stores various programs and various data used by the arithmetic processing device for calculations. The arithmetic processing device performs various calculations based on a predetermined program stored in the storage device. The arithmetic processing device outputs various control signals to each unit via the input and output interface device according to the arithmetic results. The control device 60 includes an item basic information acquisition unit 61, a template calling unit 62, a process information editing reception unit 63, a sewing information input reception unit 64, and an item information output unit 65.

The item basic information acquisition unit 61 acquires the item basic information Dd input from the input device 11 by the operator or the manager.

The template calling unit 62 acquires the template stored in the database 54. Specifically, the item basic information acquisition unit 61 acquires a template corresponding to the acquired item basic information Dd, and outputs the acquired template to the display device 12 for display.

The process information editing reception unit 63 receives input data input from the input device 11 by the operator or the manager to edit the process information and the sewing machine model information of the template displayed on the display device 12. The process information of the template can be edited by inserting and deleting processes, changing the sewing machine model for each process, and the like, for example.

The sewing information input reception unit 64 receives the input data input from the input device 11 by the operator or the manager to input the sewing information for each process in addition to the template information.

The item information output unit 65 generates and outputs the item information De including the process information and the sewing machine model information of the template called out from the database 54 by the template calling unit 62 based on the item basic information Dd. More specifically, the item information output unit 65 generates and outputs the item information De that reflects, on the template called out from the database 54 by the template calling unit 62 based on the item basic information Dd, the editing results received by the process information editing reception unit 63 and the sewing information received by the sewing information input reception unit 64. When the operator or the manager performs a predetermined operation using the input device 51, the item information output unit 65 stores the generated item information De in the storage device. When the operator or the manager performs a predetermined operation using the input device 51, the item information output unit 65 outputs a control signal to the communication device 53 to transmit the generated item information De to the sewing information generation apparatus 10B. The item information De is transmitted by the communication device 53 to the sewing information generation apparatus 10B.

In the sewing information generation apparatus 10B of the third embodiment, the same configurations as those of the sewing information generation apparatus 10A of the second embodiment are given the same reference numerals, and the description thereof will be omitted as appropriate, while different configurations, functions, and operations will be described. The sewing information generation apparatus 10B includes the input device 11, the display device 12, the communication device 13, the database 14, and a control device 20B. Further, the control device 20B includes an item information acquisition unit 21A, the operating condition search unit 22, the operating condition editing reception unit 23, the sewing information generation unit 24, and the database update unit 25A. In the sewing information generation apparatus 10B, the item information acquisition unit 21A of the control device 20B has a different function from the item information acquisition unit 21 of the second embodiment.

The item information acquisition unit 21A acquires the item information De received from the process information generation apparatus 50 by the communication device 13. That is, while the item information acquisition unit 21 of the first and the second embodiments acquires the item information Da manually input by the operator or the manager, the item information acquisition unit 21A of the third embodiment acquires the item information De output by the process information generation apparatus 50. The item information acquisition unit 21A outputs the acquired item information De to the operating condition search unit 22.

The other functions of the sewing information generation apparatus 10B are executed by replacing the item information Da in the second embodiment with the item information De, and so the description thereof will be omitted.

<Sewing Management Method>

Figure 10:
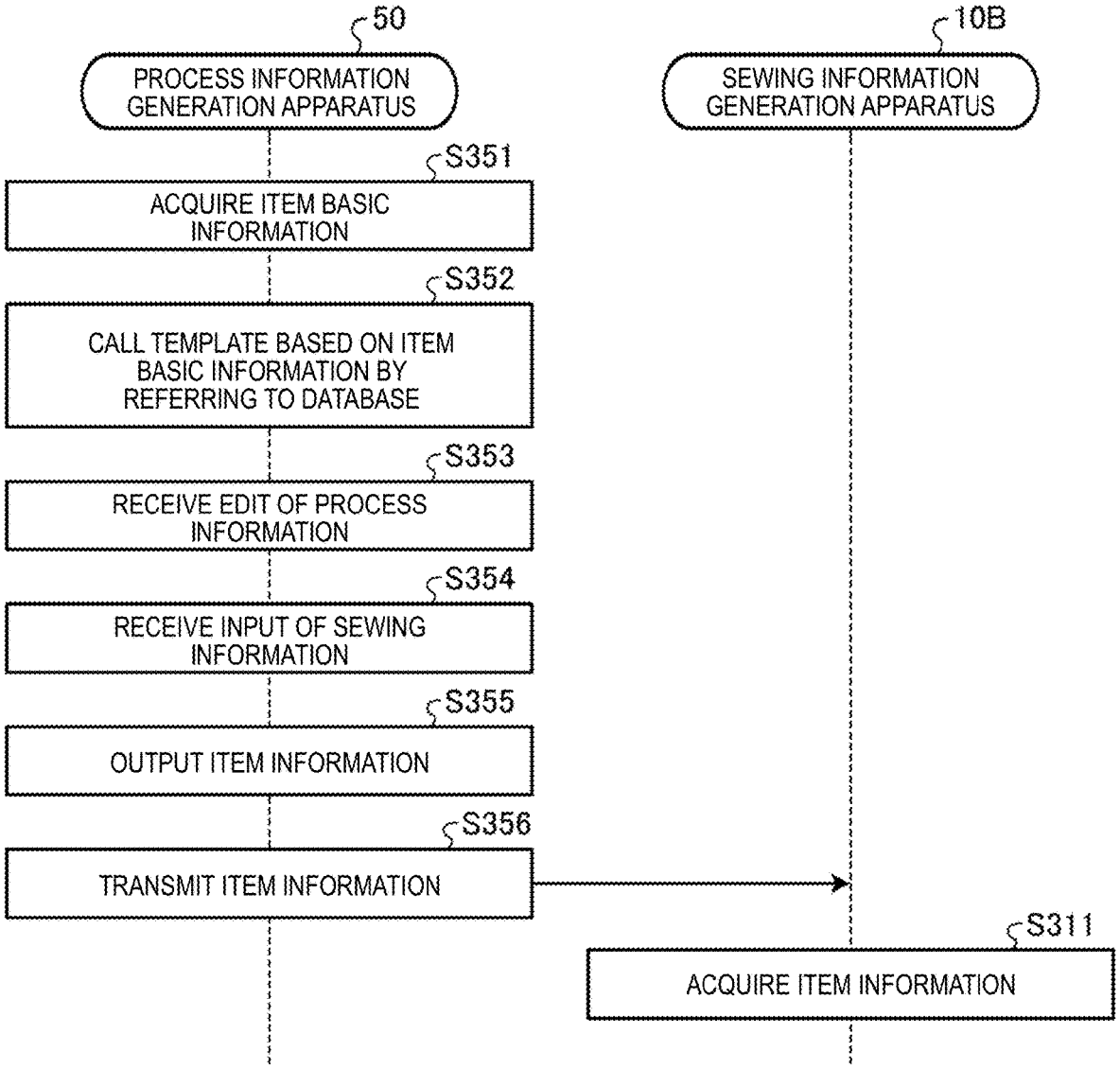
FIG. 10 is a flowchart showing an operation of the sewing system according to the third embodiment.
Figure 11:
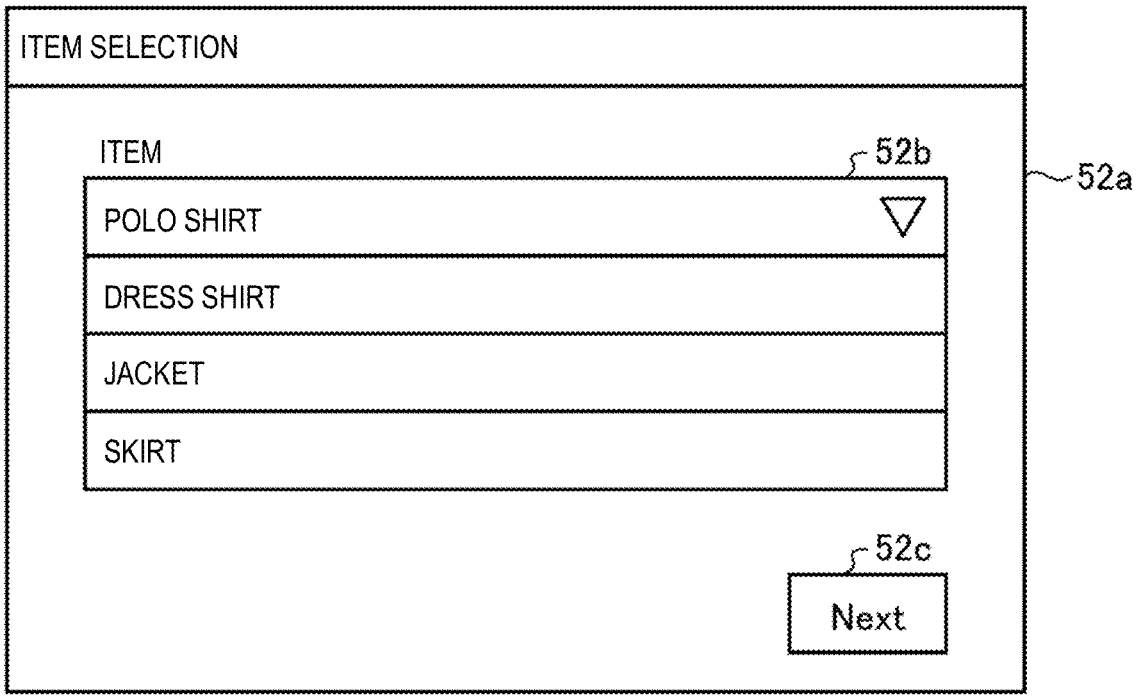
FIG. 11 is a diagram schematically showing an operation of the process information generation apparatus shown in FIG. 9.
Figure 12:
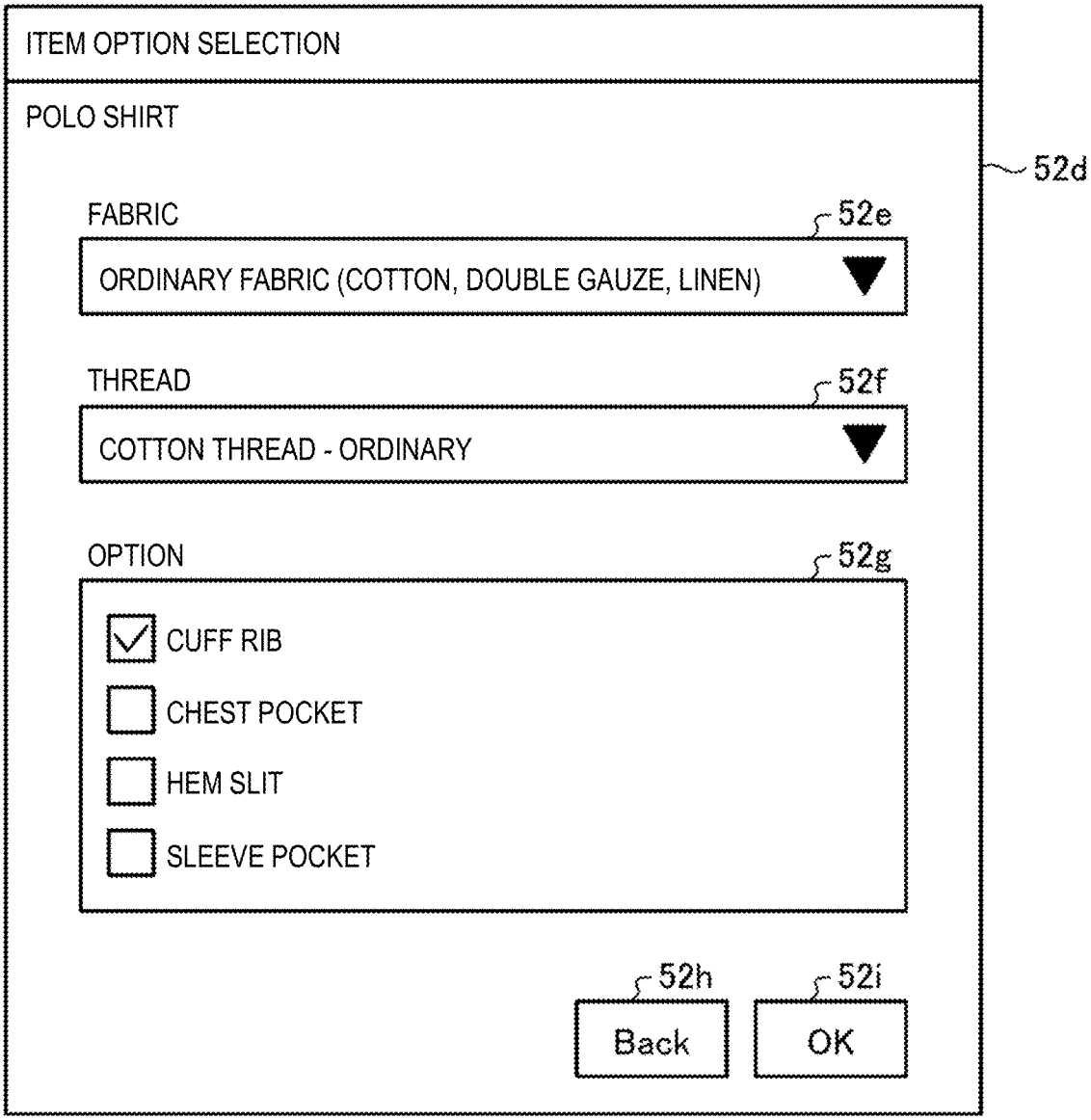
FIG. 12 is a diagram schematically showing the operation of the process information generation apparatus shown in FIG. 9.
Figure 13:
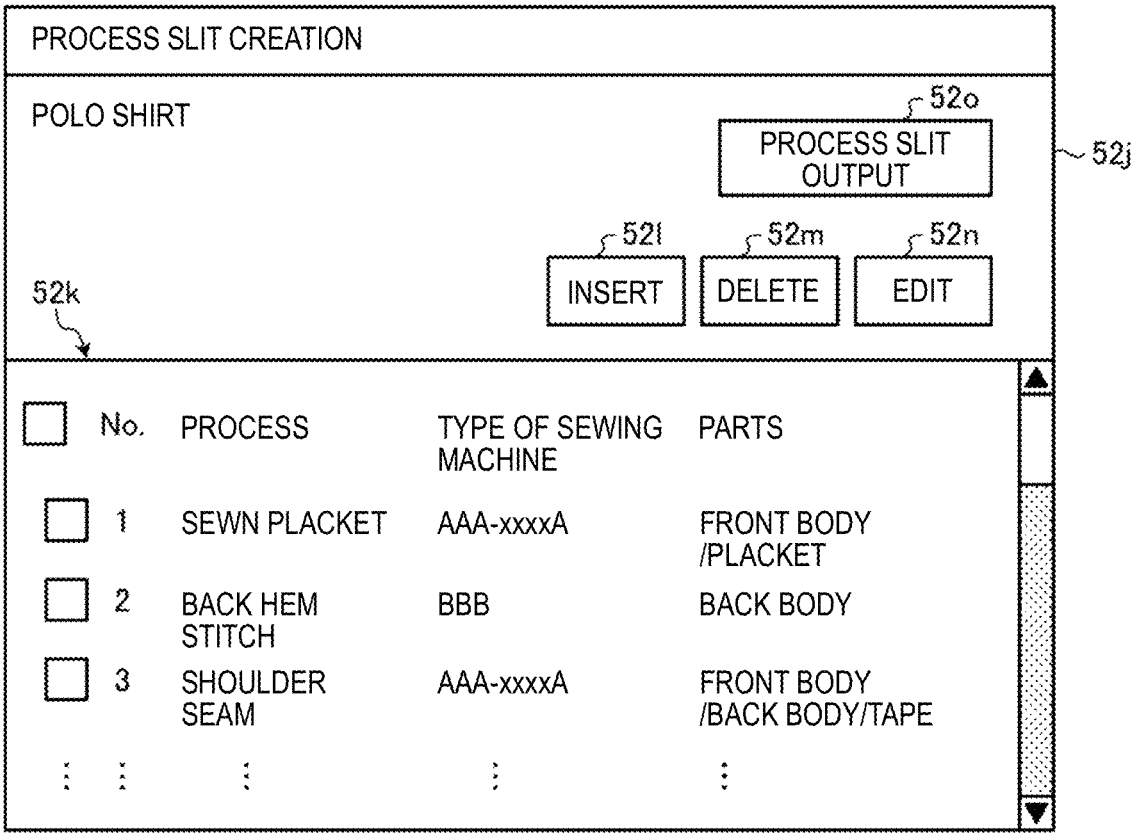
FIG. 13 is a diagram schematically showing the operation of the process information generation apparatus shown in FIG. 9.

FIG. 10 is a flowchart showing the operation of the sewing system 3 according to the third embodiment. FIGS. 11 to 13 are diagrams schematically showing the operation of the process information generation apparatus 50 shown in FIG. 9.

The operator or the manager operates the input device 51 of the process information generation apparatus 50 to input the item basic information Dd. The item basic information acquisition unit 61 of the process information generation apparatus 50 acquires the item basic information Dd input from the input device 51 (step S351).

Hereinafter, an example of the operation of inputting the item basic information Dd to the process information generation apparatus 50 will be described. FIGS. 11 and 13 are diagrams showing examples of input screens for item basic information Dd displayed on the display device 52 of the process information generation apparatus 50. As shown in FIG. 11, for example, when the operator or the manager performs a predetermined start request operation using the input device 51, the display device 52 displays display data in a display area 52*a* that receives input of the item basic information Dd.

The display area 52*a* receives an operation for selecting the type of item that is a sewn product to be produced. The display area 52*a* includes a display area 52*b* and a display area 52*c*. In the display area 52*b*, the types of items that are sewn products to be produced are displayed as a pull-down list. The operator or the manager selects the type of item from the pull-down list. The operator or the manager selectively selects the type of item from the pull-down list. A "Next" button for displaying a display area 52*d* shown in FIG. 12 instead of the display area 52*a* is displayed in the display area 52*c*.

The display area 52*d* receives an operation for selecting the type of fabric and thread used as the material of the selected item, and the options for the item. The options are information regarding the presence or absence of parts that can be selectively added to the item. The display area 52*d* includes a display area 52*e*, a display area 52*f*, a display area 52*g*, a display area 52*h*, and a display area 52*i*. The types of fabrics used as the materials for the item are displayed as a pull-down list in the display area 52*e*. The operator or the manager selectively selects the type of fabric from the pull-down list. The types of threads used as the materials for the item are displayed as a pull-down list in the display area 52*f*. The operator or the manager selectively selects the type of thread from the pull-down list.

Types of options are displayed as a checkbox list in the display area 52*g*. The operator or the manager selects, from 0 to all, the displayed types of options. A "Back" button for displaying the display area 52*a* shown in FIG. 11 instead of the display area 52*d* is displayed in the display area 52*h*. An "OK" button for confirming the information input in the display area 52*a* and the display area 52*d* is displayed in the display area 52*i*. When the operator or the manager presses an "OK" button in the display area 52*i*, the item basic information Dd is output.

The template calling unit 62 of the process information generation apparatus 50 calls a template corresponding to the item basic information Dd from the templates accumulated in the database 54 (step S352). The template includes a process list that is a table which corresponds to the item basic information Dd, and in which items related to the process information are arranged in the order in which a plurality of processes are performed. The template calling unit 62 displays the template in the display device 52.

The operator or the manager can operate the input device 51 of the process information generation apparatus 50 to edit the process information and the sewing machine model information for the template called out by the template calling unit 62. The process information editing reception unit 63 receives and changes the editing of the process information and the sewing machine model information input from the input device 51 (step S353).

Hereinafter, an example of the operation of editing the template information will be described. FIG. 14 is a diagram showing an example of a template editing screen displayed on the display device 52 of the process information generation apparatus 50. For example, when the "OK" button in the display area 52*i* shown in FIG. 13 described above is pressed, the display device 52 displays display data in a display area 52*j* that displays the called template.

The display area 52*j* receives editing of the process information and the sewing machine model information that have been input into the template in advance. The display area 52*j* includes the display area 52*k*, a display area 52*l*, a display area 52*m*, a display area 52*n*, and a display area 520. A process list with the process information and the sewing machine model information input thereto is displayed in the display area 52*k*. An "Insert" button for inserting a new process into the process list is displayed in the display area 52*l*. A "Delete" button for deleting a predetermined process from the process list is displayed in the display area 52*m*. An "Edit" button for editing the contents of a predetermined process in the process list is displayed in the display area 52*n*. A "Process list output" button for confirming and outputting the process list displayed in the display area 52*k* is displayed in the display area 520.

The operator or the manager operates the input device 51 of the process information generation apparatus 50 to add and input the sewing information for each process to the output process list. The sewing information input reception unit 64 receives the sewing information input from the input device 51 (step S354).

The item information output unit 65 of the process information generation apparatus 50 generates and outputs the item information De including the process list including the process information, the sewing machine model information, and the sewing information (step S355). For example, the item information output unit 65 outputs the generated item information De to the display device 52 for display. When the operator or the manager confirms the displayed item information De and performs a predetermined operation using the input device 51, the item information output unit 65 stores the generated item information De in the storage device.

The process information generation apparatus 50 transmits the item information De to the sewing information generation apparatus 10B (step S356). Specifically, for example, when the operator or the manager performs a predetermined operation using the input device 51, the item information output unit 65 outputs a control signal to the communication device 53 to transmit the generated item information De to the sewing information generation apparatus 10B. The item information De is transmitted by the communication device 53 to the sewing information generation apparatus 10B.

The communication device 13 of the sewing information generation apparatus 10B receives the item information De transmitted from the process information generation apparatus 50. The item information acquisition unit 21A of the sewing information generation apparatus 10B acquires the item information De received by the communication device 13 (step S311).

FIG. 14 is a diagram showing an example of information included in the item information De shown in FIG. 8. As shown in FIG. 14, the item information De of the third embodiment includes information in which "item", "product number", "process", "sewing machine", "parts", "fabric type", "fabric thickness", "thread type", "thread thickness", and the like are associated with each other for each process.

The "item", "product number", "process", "parts", "fabric type", "fabric thickness", "thread type", and "thread thickness" are the same as the item information Da of the first embodiment, so the description thereof will be omitted. The "sewing machine" is information on the model type of the sewing machine that performs each process. The "item", "product number", "process", "sewing machine", and "Parts" are included in the template, and the contents can be manually edited by the operator or the manager in step S353. The "fabric type", "fabric thickness", "thread type", and "thread thickness" are manually input by the operator or the manager in step S354.

<Effects>

As described above, according to the third embodiment, the template is provided that includes the process list input with the process information and the sewing machine model information that are associated with item basic information Dd that includes the information on the sewn product to be produced, the fabric to be sewn, and the type of thread used for sewing. The process list displays the items related to the process information so as to be arranged in the order in which a plurality of processes are performed. A plurality of templates are prepared in the database 54, and the template corresponding to the input item basic information Dd is searched and presented. As a result, the operator or the manager can obtain the process list by simply inputting the item basic information Dd, thereby shortening the process related to preparation for sewing by the sewing machine M.

The process information and the sewing machine model information included in the presented template can be edited. In addition, by adding and inputting, to the process list, the sewing information including the material information such as the thickness of the fabric to be sewn and the thickness of the thread used for sewing, the item information De for acquiring sewing information Db can be acquired. That is, since it is not necessary to manually input all the item information De, it is possible to further shorten the processes involved in preparing the sewing machine M for sewing.

Fourth Embodiment

<Sewing System>

Figure 15:
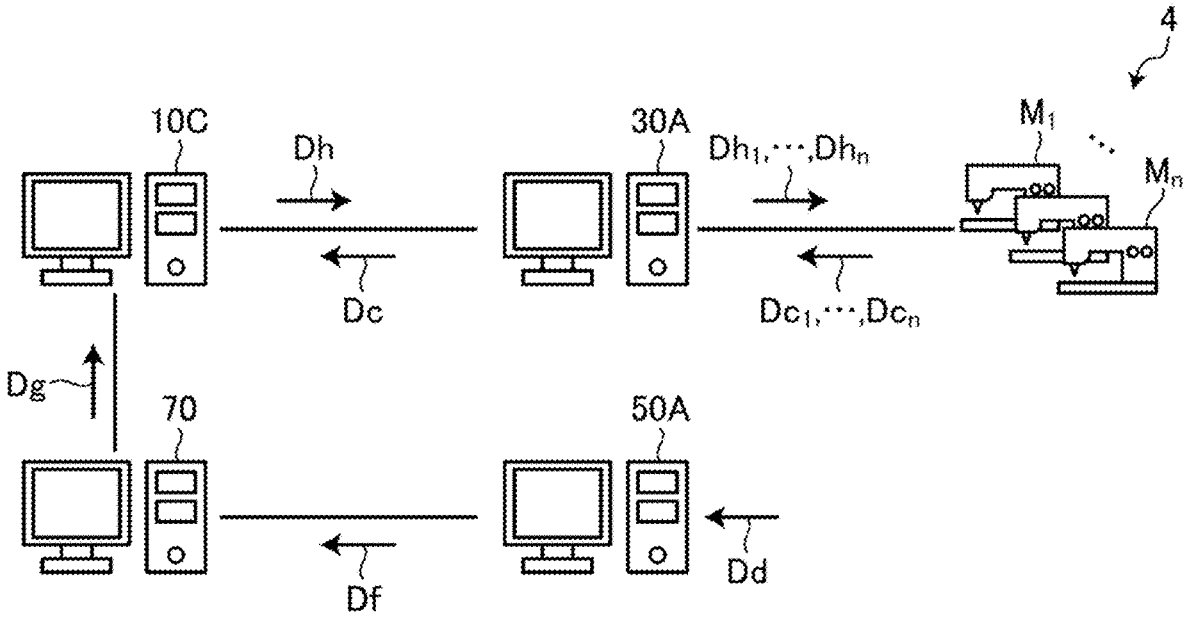
FIG. 15 is a diagram schematically showing a sewing system according to a fourth embodiment.

FIG. 15 is a diagram schematically showing a sewing system 4 according to a fourth embodiment. In the sewing system 4 of the fourth embodiment, the same configurations as those of the sewing system 3 of the third embodiment are given the same reference numerals, and the description thereof will be omitted as appropriate, while different configurations, functions, and operations will be described. As shown in FIG. 15, the sewing system 4 includes a sewing information generation apparatus 10C, the management apparatus 30A, a process information generation apparatus 50A, a design information processing apparatus 70, and a plurality of sewing machines M. The sewing system 4 differs from the sewing system 3 of the third embodiment in that, instead of outputting the item information De, the process information generation apparatus 50 outputs process list information Df to the design information processing apparatus 70, and the design information processing apparatus 70 outputs item information Dg. Furthermore, the sewing system 4 is different from the sewing system 3 of the third embodiment in that, instead of outputting the sewing information Db based on the item information De, the sewing information generation apparatus 10C outputs sewing information Dh based on the item information Dg. Furthermore, in the fourth embodiment, the sewing machine M is not limited to a lockstitch type sewing machine, but includes cycle sewing machines, differential feed sewing machines, button sewing machines, and the like.

The process list information Df is data that includes process information and sewing machine model information that is information on the model type of the sewing machine M that performs each process. The process information includes the type and product number of the item to be produced, a plurality of processes for producing the item, parts to be sewn used in each process, and the like. In other words, compared to the item information De of the third embodiment, the process information Df is data that does not include the sewing information in each process.

The item information Dg is data including process information, sewing machine model information that is information on the model type of the sewing machine M that performs each process, graphic information of parts used in each process, sewing information in each process, correspondence table information thereof, and the like. The process information overlaps in content with the process information in the process list information Df. That is, the item information Dg is data obtained by further adding the graphic information of parts used in each process and the correspondence table information to the item information De of the third embodiment. Further, the third embodiment differs from the fourth embodiment in that the sewing information of the item information De in the third embodiment is manually input by the operator or the manager, but the sewing information of the item information Dg of the fourth embodiment is output from the design information processing apparatus 70.

The graphic information is data obtained by extracting design data including sewing shape information related to parts for each process. The sewing shape information includes two-dimensional information such as the shape of a pattern for pattern sewing, the position of a notch for shirring sewing, the position of a button, the position of a button hole, for example. The graphic information is data that is output in a divided state for each process.

As described above, the sewing information includes the material information such as the fabric to be sewn, buttons, tapes, and threads used. In other words, the sewing information is information that serves as a basis for determining for appropriately setting the operating conditions of the sewing machine M. The sewing information is data that is divided and output for each process.

The correspondence table information is data of a correspondence table in which, corresponding to the process list information Df, items of graphic information and sewing information are added to the process list in which items related to the process information are arranged in the order in which a plurality of processes are executed. The correspondence table shows the names or identifiers of files storing the graphic information and the sewing information corresponding to each process. It is to be noted that in the correspondence table, the file names and identifiers of the graphic information are not shown in the sewing processes such as lock stitching that do not use the graphic information.

The sewing information Dh is data that includes the process information and sewing machine information that is information on the sewing machine M that performs each process. The process information overlaps in content with the process information of the item information Da. The sewing machine information includes a model type of the sewing machine M that performs each process, and operating conditions of the sewing machine M including set values for operating the sewing machine M. When the sewing machine M is a lockstitch sewing machine, the set values include a stitch length (an amount of movement per stitch), a number of stitches, thread tension, presser pressure, fabric feed speed, and the like, for example. When the sewing machine M is a cycle sewing machine, a differential feed sewing machine, or a button sewing machine, the set values further include needle drop information indicating the coordinates of the needle drop position, table movement speed, and the like, for example. When the sewing machine M is a differential feed sewing machine, the set value further includes the amount of shirring, and the like, for example. That is, the sewing information Dh is data obtained by adding information corresponding to the sewing machine M that requires the graphic information to the sewing information Db of the first to third embodiments. The sewing information Dh is generated by the sewing information generation apparatus 10C and output to the management apparatus 30A. The sewing information Dh is distributed to sewing information Dh1, . . . , Dhn corresponding to the respective sewing machines $M_1, \ldots, M_n$ in the management apparatus 30A.

The design information processing apparatus 70 is an information terminal that is operated by the operator or the manager to extract the graphic information and the sewing information from CAD information based on the acquired process list information Df, generate a correspondence table, and output the item information Dg including the correspondence table information, the graphic information, and the sewing information. As a typical example of the design information processing apparatus 70, a desktop PC or a notebook PC is assumed, but it may also be implemented by a smartphone, a tablet terminal, a mobile phone, a PDA, and the like. The design information processing apparatus 70 is installed in the office section of a sewing factory, for example.

<Sewing Information Generation Apparatus, Management Apparatus, Process Information Generation Apparatus, and Design Information Processing Apparatus>

Figure 16:
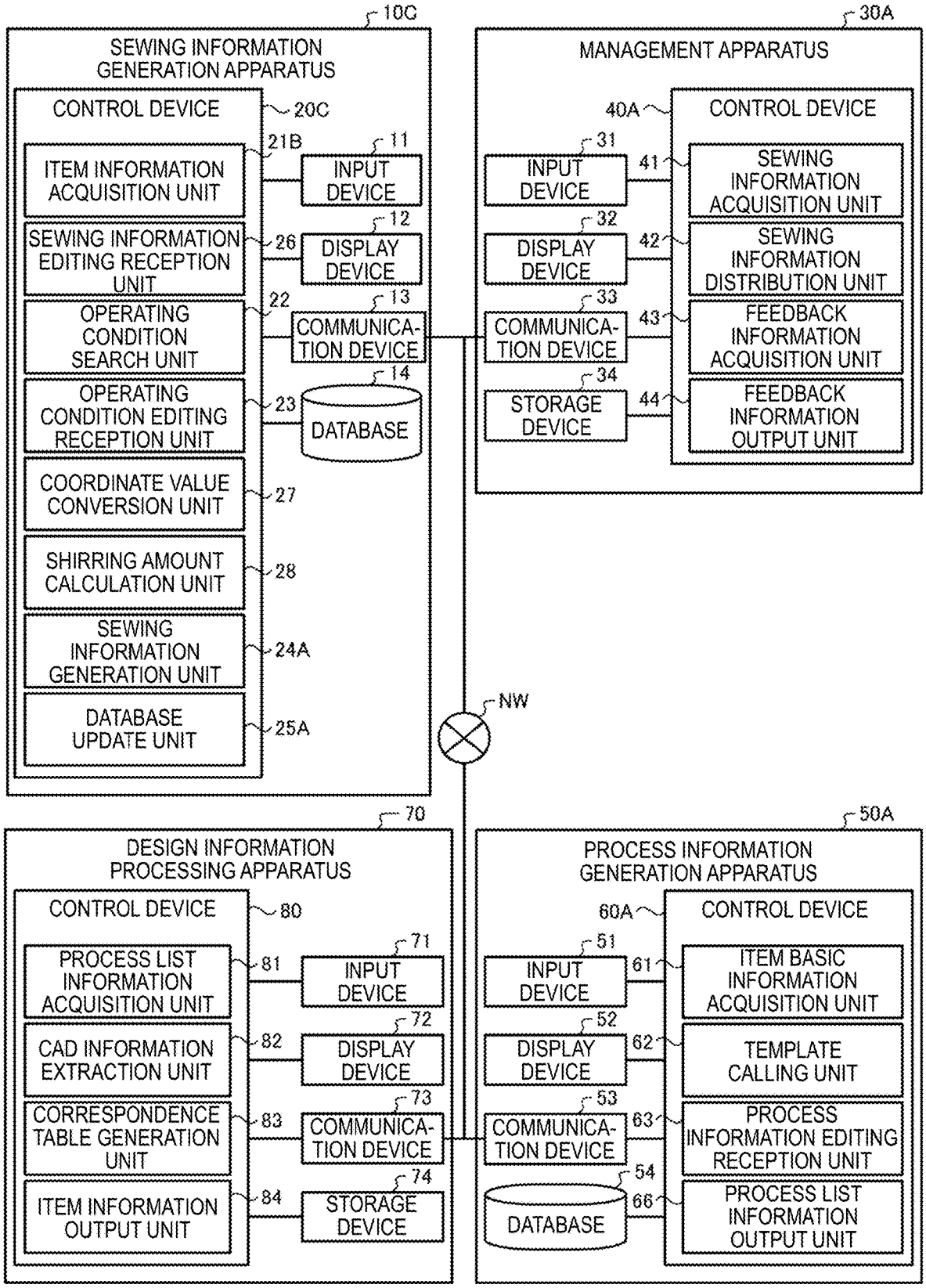
FIG. 16 is a functional block diagram showing a sewing information generation apparatus, a management apparatus, a process information generation apparatus, and a design information processing apparatus according to the fourth embodiment.

FIG. 16 is a functional block diagram showing the sewing information generation apparatus 10C, the management apparatus 30A, the process information generation apparatus 50A, and the design information processing apparatus 70 according to the fourth embodiment. In the process information generation apparatus 50A of the fourth embodiment, the same configurations as those of the process information generation apparatus 50 of the third embodiment are given the same reference numerals, and the description thereof will be omitted as appropriate, while different configurations, functions, and operations will be described. As shown in FIG. 16, the process information generation apparatus 50A includes the input device 51, the display device 52, the communication device 53, the database 54, and a control device 60A. The control device 60A includes the item basic information acquisition unit 61, the template calling unit 62, the process information editing reception unit 63, and a process list information output unit 66. The process information generation apparatus 50A is different from the control device 60 of the third embodiment in that the control device 60A includes the process list information output unit 66 instead of the sewing information input reception unit 64 and the item information output unit 65.

The process list information output unit 66 generates and outputs the process list information Df that reflects the editing results received by the process information editing reception unit 63 on the template called by the template calling unit 62 from the database 54 based on the item basic information Dd. When the operator or the manager performs a predetermined operation using the input device 51, the process list information output unit 66 stores the generated process list information Df in the storage device. When the operator or the manager performs a predetermined operation using the input device 51, the process list information output unit 66 outputs a control signal to the communication device 53 to transmit the generated process list information Df to the design information processing apparatus 70. The process list information Df is transmitted to the design information processing apparatus 70 by the communication device 53.

FIG. 17 is a diagram showing an example of information included in the process list information Df shown in FIG. 15. As shown in FIG. 17, the process list information Df of the fourth embodiment includes information in which "item", "product number", "process", "sewing machine", and "parts" are associated with each other for each process. "item", "product number", "process", "sewing machine", and "parts" are the same as the item information De of the third embodiment, so the description thereof will be omitted.

As shown in FIG. 16, the design information processing apparatus 70 includes an input device 71, a display device 72, a communication device 73, a storage device 74, and a control device 80.

The input device 71 receives various input operations by the manager. The input device 71 is operated to generate the input data. The input device 71 is implemented by a keyboard, a mouse, operation keys, a microphone that receives voice input, or the like, for example. When the design information processing apparatus 70 is a smartphone or a tablet terminal, the input device 71 may be an operation panel including a touch sensor arranged on the display screen of the display device 72, for example.

The display device 72 displays various information. The display device 72 includes a flat panel display such as a liquid crystal display or an organic EL display, for example.

The communication device 73 communicates with the sewing information generation apparatus 10C and the process information generation apparatus 50A via the communication network NW. The communication device 73 transmits the item information De to the sewing information generation apparatus 10B.

The storage device 74 is implemented by a primary storage device that is a volatile memory such as RAM, and a secondary storage device that is a nonvolatile memory such as ROM, or HDD, SSD, or a storage. The storage device 74 stores CAD information. The CAD information includes design data such as parts, sewing patterns, notches for sewing together, which are shape data, and data of sewing specification. The design data is stored as a DXF file, for example. The data of sewing specification is stored as an XLS file, for example.

The control device 80 includes a computer system including an arithmetic processing device as an operation means, a storage device as a storage means, and an input and output interface device, and executes various controls in each unit of the design information processing apparatus 70. The arithmetic processing device includes a processor such as a CPU or MPU, for example. For example, the storage device includes a primary storage device such as RAM, which is a volatile memory that temporarily stores data, and a secondary storage device such as ROM, HDD, SSD, or a storage, which is a non-volatile memory that stores various programs and various data used by the arithmetic processing device for calculations. The arithmetic processing device performs various calculations based on a predetermined program stored in the storage device. The arithmetic processing device outputs various control signals to each unit via the input and output interface device according to the arithmetic results. The control device 80 includes a process list information acquisition unit 81, a CAD information extraction unit 82, a correspondence table generation unit 83, and an item information output unit 84.

The process list information acquisition unit 81 acquires the process list information Df received from the process information generation apparatus 50A by the communication device 73.

The CAD information extraction unit 82 extracts, based on the information on the part to be sewn used in each process included in the process list information Df acquired by the process list information acquisition unit 81, and, from the CAD information stored in the storage device 74, the design data including the shape data for sewing related to the part and the data of sewing specification corresponding to the part, and outputs the same. The extracted design data is output as graphic information for each process in a DXF file, for example. The extracted data of sewing specification is output as the sewing information for each process in an XLS file, for example.

The correspondence table generation unit 83 generates correspondence table information that includes the process list information Df and that is obtained by associating each process in the process list information Df with the graphic information and the sewing information extracted from the CAD information and adding the items of the graphic information file name and the sewing information file name to the process list information Df.

FIG. 18 is a diagram showing an example of information included in the correspondence table of the item information Dg shown in FIG. 15. As shown in FIG. 18, the correspondence table of item information Dg of the fourth embodiment includes information in which "item", "product number", "process", "sewing machine", "parts", "graphic information", and "sewing information" are associated with each other for each process.

"item", "product number", "process", "sewing machine", and "parts" are the same as the process list information Df shown in FIG. 17 and the item information De of the third embodiment, so the description thereof will be omitted. The "graphic information" is information including a name or an identifier indicating a file in which the design data of the parts to be sewn used in each process is stored. The "sewing information" is information including a name or an identifier indicating a file in which the sewing information including the material information such as fabric and thread used in each process is stored.

The item information output unit 84 outputs, as the item information Dg, a combination of the correspondence table information generated by the correspondence table generation unit 83, and, a plurality of pieces of graphic information included in the correspondence table information and extracted by the CAD information extraction unit 82, and a plurality of pieces of sewing information included in the correspondence table information. When the operator or the manager performs a predetermined operation using the input device 71, the item information output unit 84 stores the item information Dg in the storage device. When the operator or the manager performs a predetermined operation using the input device 71, the item information output unit 84 outputs a control signal to the communication device 73 to transmit the generated item information Dg to the sewing information generation apparatus 10C. The item information Dg is transmitted by the communication device 73 to the sewing information generation apparatus 10C.

In the sewing information generation apparatus 10C of the fourth embodiment, the same configurations as those of the sewing information generation apparatus 10B of the third embodiment are given the same reference numerals, and the description thereof will be omitted as appropriate, while different configurations, functions, and operations will be described. As shown in FIG. 16, the sewing information generation apparatus 10C includes the input device 11, the display device 12, the communication device 13, the database 14, and a control device 20C. In addition, the control device 20C includes the item information acquisition unit 21A, a sewing information editing reception unit 26, the operating condition search unit 22, the operating condition editing reception unit 23, a coordinate value conversion unit 27, a shirring amount calculation unit 28, a sewing information generation unit 24A, and the database update unit 25A. The sewing information generation apparatus 10C is different from the control device 20B of the third embodiment in that the control device 20C further includes the sewing information editing reception unit 26, the coordinate value conversion unit 27, and the shirring amount calculation unit 28. Furthermore, in the sewing information generation apparatus 10C, the item information acquisition unit 21B and the sewing information generation unit 24A of the control device 20C have different functions from the item information acquisition unit 21A and the sewing information generation unit 24 of the third embodiment.

The item information acquisition unit 21B acquires the item information Dg received from the design information processing apparatus 70 by the communication device 13. The item information acquisition unit 21B outputs the acquired item information Dg to the operating condition search unit 22, the coordinate value conversion unit 27, and the shirring amount calculation unit 28.

The sewing information editing reception unit 26 receives editing of the sewing information input from the input device 11 by the operator or the manager regarding the sewing information included in the item information Dg. The editing of the sewing information is useful when the sewing information extracted from the CAD information in the design information processing apparatus 70 is insufficient as a search condition to be input in the operating condition search unit 22, for example. The operating condition search unit 22 searches for and acquires the operating conditions of the sewing machine M corresponding to the search conditions based on the item information Dg with the edited sewing information.

If the model type of the sewing machine M for the process included in the item information Dg is a sewing machine M such as a cycle sewing machine that handles graphic information, the coordinate value conversion unit 27 converts the graphic information associated with the process included in the item information Dg into coordinate values for the sewing machine M to perform sewing process. Specifically, the coordinate value conversion unit 27 converts the shape data of the sewing pattern for which the sewing process is performed by the cycle sewing machine into coordinate values that include the coordinates of the needle drop position. Further, the coordinate value conversion unit 27 converts the position of a notch, which is a mark for sewing together when the differential feed sewing machine performs shirring sewing, into coordinate values.

If the model type of the sewing machine M in the process included in the item information Dg is a differential feed sewing machine, the shirring amount calculation unit 28 calculates the shirring amount of the sewing machine M by referring to the difference in the distance between the notches of the fabric to be sewn together, based on the coordinate values of the notches included in the graphic information.

The sewing information generation unit 24A generates the sewing information Dh based on the item information Dg acquired by the item information acquisition unit 21B, the correspondence information acquired by the operating condition search unit 22, the information on the coordinate values converted by the coordinate value conversion unit 27, and the information on the shirring amount calculated by the shirring amount calculation unit 28. When the operating condition editing reception unit 23 receives the editing of the operating conditions of the sewing machine M, the sewing information generation unit 24A generates the sewing information Dh that reflects the updated operating conditions of the sewing machine M. For example, the sewing information generation unit 24A outputs the generated sewing information Dh to the display device 12 for display. When the operator or the manager confirms the displayed sewing information Dh and performs a predetermined operation using the input device 11, the sewing information generation unit 24A stores the generated sewing information Dh in the storage device. When the operator or the manager performs a predetermined operation using the input device 11, the sewing information generation unit 24A outputs a control signal to the communication device 13 to transmit the generated sewing information Dh to the management apparatus 30A. The sewing information Dh is transmitted to the management apparatus 30A by the communication device 13.

<Sewing Management Method>

Figure 19:
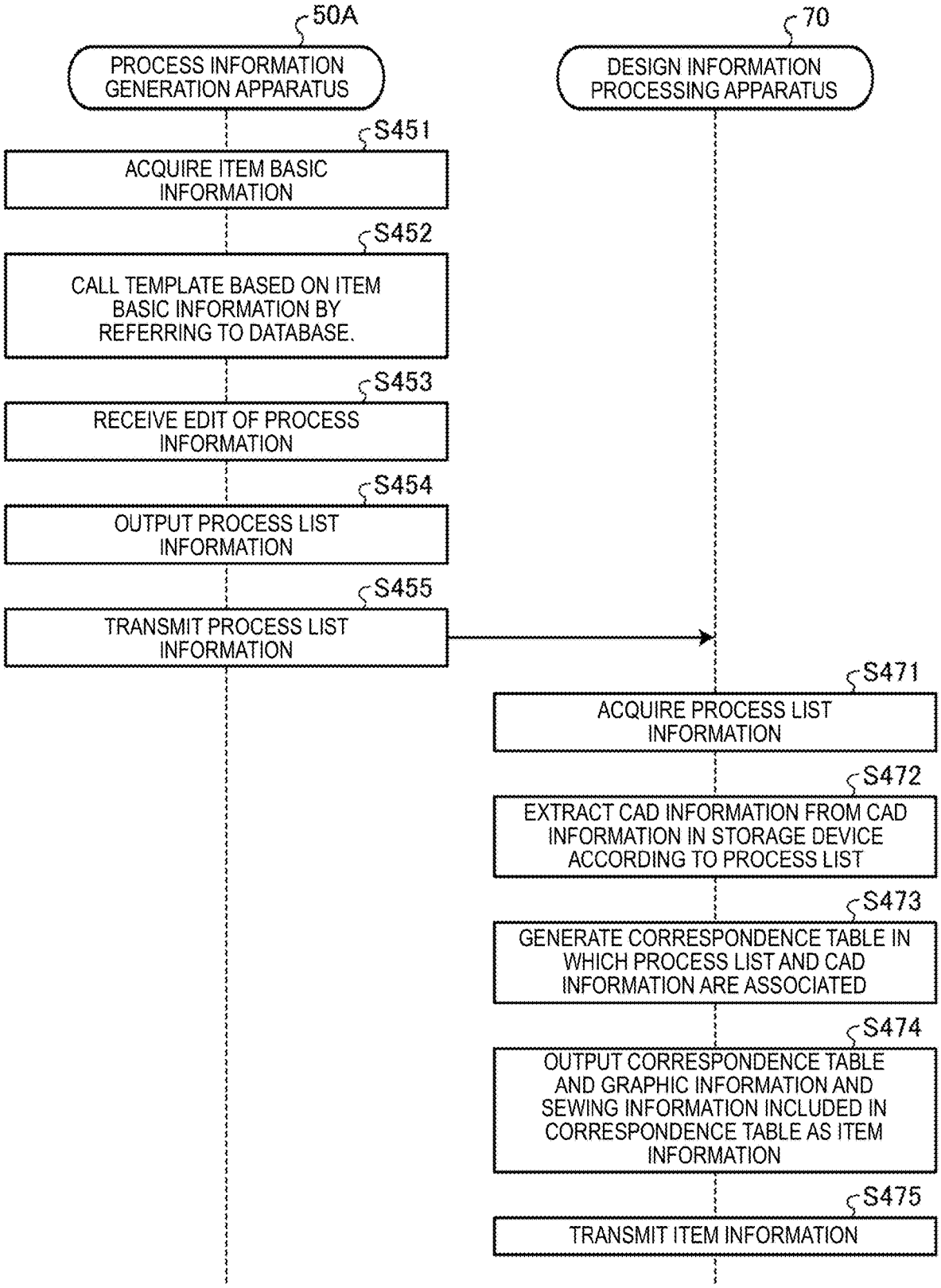
FIG. 19 is a flowchart showing an operation of the sewing system according to the fourth embodiment.
Figure 20:
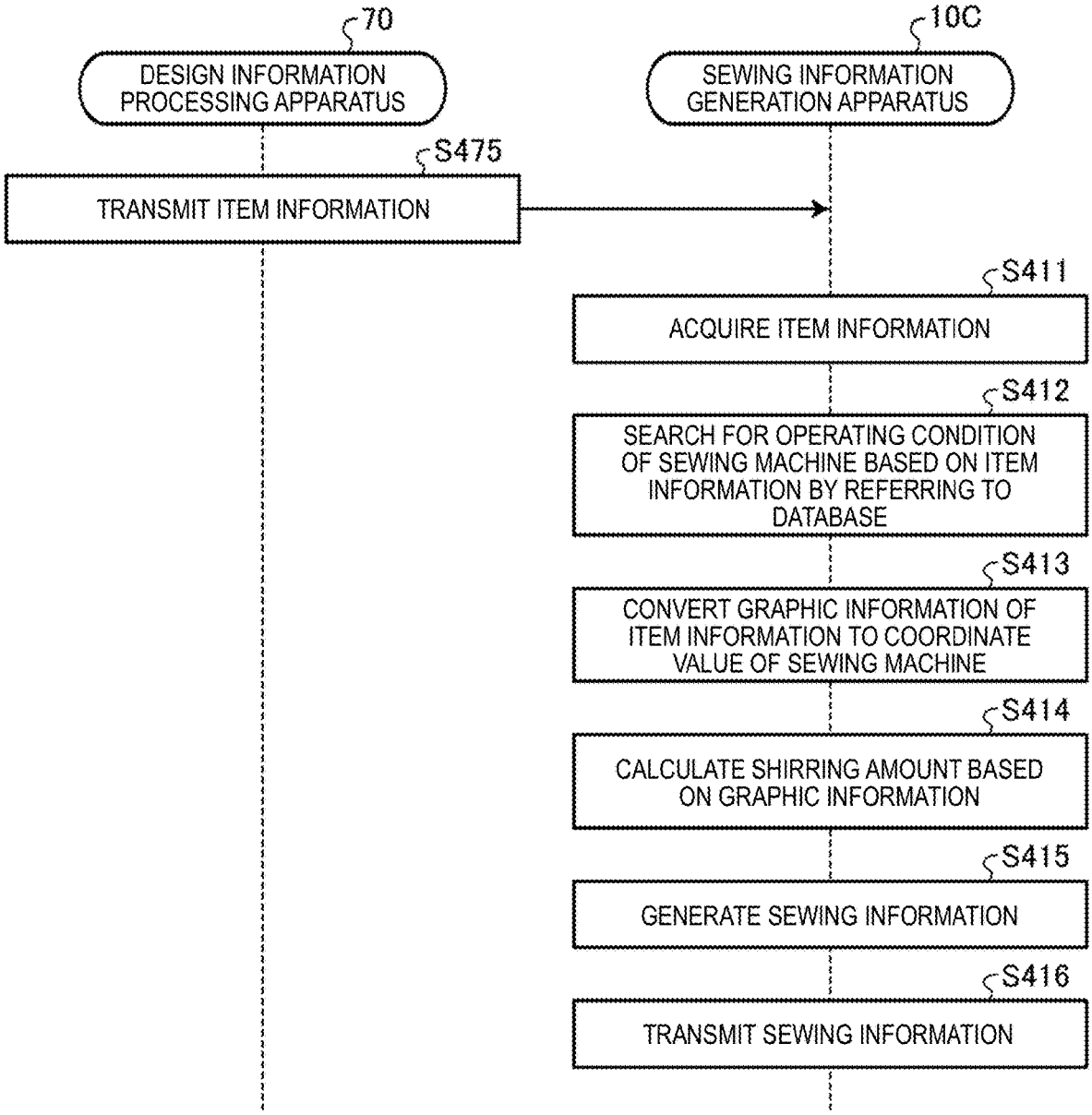
FIG. 20 is a flowchart showing the operation of the sewing system according to the fourth embodiment.

FIGS. 19 and 20 are flowcharts showing the operation of the sewing system 4 according to the fourth embodiment.

The operator or the manager operates the input device 51 of the process information generation apparatus 50A to input the item basic information Dd. The item basic information acquisition unit 61 of the process information generation apparatus 50A acquires the item basic information Dd input from the input device 51 (step S451).

The template calling unit 62 of the process information generation apparatus 50A calls a template corresponding to the item basic information Dd from the templates accumulated in the database 54 (step S452). The template includes a process list that is a table which corresponds to the item basic information Dd, and in which items related to the process information are arranged in the order in which a plurality of processes are performed. The template calling unit 62 displays the template in the display device 52.

The operator or the manager can operate the input device 51 of the process information generation apparatus 50A to edit the process information and the sewing machine model information for the template called out by the template calling unit 62. The process information editing reception unit 63 receives and changes the editing of the process information and the sewing machine model information input from the input device 51 (step S453).

The process list information output unit 66 of the process information generation apparatus 50A generates and outputs the process list information Df including the process list including process information and the sewing machine model information (step S454). For example, the process list information output unit 66 outputs the generated process list information Df to the display device 52 for display. When the operator or the manager confirms the displayed process list information Df and performs a predetermined operation using the input device 51, the process list information output unit 66 stores the generated process list information Df in the storage device.

The process information generation apparatus 50A transmits the process list information Df to the design information processing apparatus 70 (step S455). Specifically, for example, when the operator or the manager performs a predetermined operation using the input device 51, the process list information output unit 66 outputs a control signal to the communication device 53 to transmit the generated process list information Df to the design information processing apparatus 70. The process list information Df is transmitted to the design information processing apparatus 70 by the communication device 53.

The communication device 73 of the design information processing apparatus 70 receives the process list information Df transmitted from the process information generation apparatus 50A. The process list information acquisition unit 81 of the design information processing apparatus 70 acquires the process list information Df received by the communication device 73 (step S471).

The CAD information extraction unit 82 of the design information processing apparatus 70 extracts the graphic information and the material information from the CAD information stored in the storage device 74 in accordance with the process list, based on the information on parts to be sewn used in each process included in the process list information Df (step S472). The CAD information includes the design data including the shape data of the workpiece and the data of sewing specification. The extracted graphic information is data obtained by dividing the design data including the sewing shape data related to the part into each process. The extracted material information is data obtained by dividing the data of sewing specification corresponding to the part into each process.

The correspondence table generation unit 83 of the design information processing apparatus 70 generates a correspondence table in which the process list and the CAD information are associated with each other (step S473). Specifically, the correspondence table generation unit 83 generates correspondence table information that is obtained by associating each process in the process list information Df with the graphic information and the sewing information extracted from the CAD information and adding the items of the graphic information file name and the sewing information file name to the process list information Df.

The item information output unit 84 of the design information processing apparatus 70 outputs, as the item information Dg, a combination of the correspondence table generated by the correspondence table generation unit 83, a plurality of pieces of graphic information included in the correspondence table, and a plurality of pieces of sewing information included in the correspondence table (step S474). For example, the item information output unit 84 outputs the correspondence table of the item information Dg to the display device 72 for display. When the operator or the manager confirms the displayed correspondence table and performs a predetermined operation using the input device 71, the item information output unit 84 stores the item information Dg in the storage device.

The design information processing apparatus 70 transmits the item information Dg to the sewing information generation apparatus 10C (step S475). Specifically, for example, when the operator or the manager performs a predetermined operation using the input device 71, the item information output unit 84 outputs a control signal to the communication device 73 to transmit the item information Dg to the sewing information generation apparatus 10C. The item information Dg is transmitted by the communication device 73 to the sewing information generation apparatus 10C.

The communication device 13 of the sewing information generation apparatus 10C receives the item information Dg transmitted from the design information processing apparatus 70. The item information acquisition unit 21B of the sewing information generation apparatus 10C acquires the item information Dg received by the communication device 13 (step S411).

The operating condition search unit 22 of the sewing information generation apparatus 10C searches for and acquires the operating conditions of the sewing machine M based on the item information Dg by referring to the correspondence information between the material information and the operating conditions of the sewing machine M accumulated in the database 14 (step S412). At this time, the search conditions include the material information included in the item information Dg. The search conditions may include the sewing machine model information. In addition, if the database 14 does not store the correspondence information corresponding to a condition that completely matches the search condition, the operating condition search unit 22 searches for and acquires the operating condition of the sewing machine M that corresponds to the approximate search condition.

If the model type of the sewing machine M for the process included in the item information Dg is a sewing machine M such as a cycle sewing machine that handles graphic information, the coordinate value conversion unit 27 of the sewing information generation apparatus 10C converts the graphic information associated with the process included in the item information Dg into coordinate values for the sewing machine M to perform sewing process (step S413).

If the model type of the sewing machine M in the process included in the item information Dg is a differential feed sewing machine, the shirring amount calculation unit 28 of the sewing information generation apparatus 10C calculates the shirring amount of the sewing machine M by referring to the difference in the distance between the notches of the fabric to be sewn together, based on the coordinate values of the notches included in the graphic information (step S414).

The sewing information generation unit 24A of the sewing information generation apparatus 10C generates the sewing information Dh including the item information Dg and the operating conditions of the sewing machine M corresponding to the material information (step S415). For example, the sewing information generation unit 24A outputs the generated sewing information Dh to the display device 12 for display. When the operator or the manager confirms the displayed sewing information Dh and performs a predetermined operation using the input device 11, the sewing information generation unit 24A stores the generated sewing information Dh in the storage device.

The sewing information generation apparatus 10C transmits the sewing information Dh to the management apparatus 30A (step S416). Specifically, for example, when the operator or the manager performs a predetermined operation using the input device 11, the sewing information generation unit 24A outputs a control signal to the communication device 13 to transmit the generated sewing information Dh to the management apparatus 30A. The sewing information Dh is transmitted to the management apparatus 30A by the communication device 13.

<Effects>

As described above, according to the fourth embodiment, the graphic information and the material information can be extracted from the CAD information of the sewn product to be produced in accordance with the process list, based on the information on the parts to be sewn used in each process included in the process list information Df of the template presented based on the item basic information Dd. The graphic information is data obtained by extracting from the design data including the shape data of the workpiece included in the CAD information and dividing the design data including the sewing shape data related to the part into each process. The material information is data obtained by extracting from the data of sewing specification included in the CAD information and dividing the data of sewing specification corresponding to the part into each process.

According to the fourth embodiment, the sewing information Dh including the operating conditions of the sewing machine M that performs sewing can be generated based on the item information Dg including the material information extracted from CAD information. Further, the coordinate values of the shape to be sewn during pattern sewing by the cycle sewing machine can be obtained from the shape of the pattern included in the graphic information, based on the item information Dg including the graphic information extracted from the CAD information. Furthermore, based on the item information Dg including the graphic information extracted from the CAD information, the shirring amount during shirring sewing by the differential feed sewing machine can be calculated from the position of the notch for sewing together included in the graphic information.

Since the material information is extracted from the sewing specifications in this way, manual input by the operator or the manager is not required, and the processes involved in preparing for sewing by the sewing machine M can be shortened. In addition, since the graphic information is used, when adjusting the set values of the sewing machine M for each sewing process, whether the sewing machine M is the lockstitch sewing machine or the cycle sewing machine, the differential feed sewing machine, and the like that sews a predetermined shape, the settings can be made according to the sewing information Dh, so that the process related to preparation for sewing by the sewing machine M can be shortened.

[Computer System]

Figure 21:
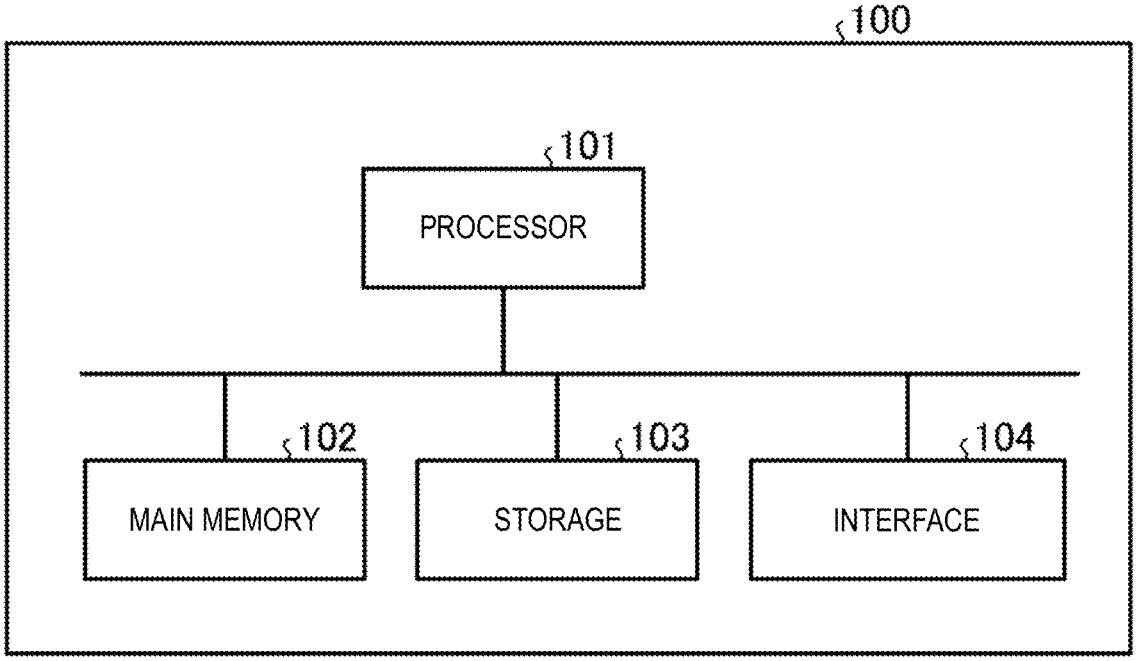
FIG. 21 is a block diagram showing a computer system according to the present embodiment.

FIG. 21 is a block diagram showing a computer system 100 according to the present embodiments. The computer system 100 includes at least one of the sewing information generation apparatuses 10, 10A, 10B, and 10C, the management apparatuses 30 and 30A, the process information generation apparatuses 50 and 50A, and the design information processing apparatus 70 of each of the embodiments described above. The computer system 100 includes a processor 101 such as a CPU, a main memory 102 including a non-volatile memory such as a ROM and a volatile memory such as a RAM, a storage 103, and an interface 104 including an input and output circuit. The functions of the computer system 100 are stored in the storage 103 as computer programs. The computer programs include various application software for implementing the functions described above. The processor 101 reads the computer program from the storage 103, loads it into the main memory 102, and executes the processes described above according to the computer program. The computer program may be distributed to the computer system 100 via a computer network.

The computer program can execute, according to the embodiments described above, the acquisition of the item information Da, De, and Dg including the material information indicating the information on materials including the fabric to be sewn and the thread used for sewing, and the generation of the sewing information Db and Dh including the operating conditions of the sewing machine M that performs sewing based on the item information Da, De, and Dg.

Other Embodiments

Although the embodiments of the present application have been described above, the present disclosure is not limited to the contents of these embodiments. In addition, the components described above include components that can be easily assumed by a person skilled in the art, those that are substantially the same, and those that fall within a so-called equivalent range. Furthermore, the components described above can be combined as appropriate. Furthermore, various omissions, substitutions, or changes of the components can be made without departing from the gist of the embodiments described above. For example, the sewing system can suitably combine some or all of the functions of the sewing systems 1, 2, 3, and 4 of the embodiments described above without conflicting with the processing content.

In addition, each component of each apparatus shown in the drawings is functionally conceptual, and does not necessarily need to be physically configured as shown in the drawings. In other words, the specific form of distributing and integrating each apparatus is not limited to that shown in the drawings, and all or part of them can be configured by functionally or physically distributing and integrating them into arbitrary units according to various loads, usage conditions, and the like.

For example, in the embodiments described above, the sewing information generation apparatuses 10, 10A, 10B, and 10C, the management apparatuses 30 and 30A, the process information generation apparatuses 50, and 50A, and the design information processing apparatus 70 may be configured by a separate computer as in the embodiment, or configured by a plurality of computers or one computer that integrates several functions, or configured by a plurality of computers that are divided into several functions. In addition, some functions of the computer may be provided by a cloud server that executes various functions in the form of cloud computing. Furthermore, the internal configurations of the control devices 20, 20A, 20B, 20C, 40, 40A, 60, 60A, and 80 of the sewing systems 1, 2, 3, and 4 in each embodiment are not limited to the configurations shown in FIGS. 2, 6, 9, and 16, and may be any other configuration as long as it performs the information processing described above.

What is claimed is:

1. A sewing system comprising:

an item information acquisition unit that acquires item information including material information indicating information on materials including fabric to be sewn and thread used for sewing, and the item information includes process information including information on a sewn product to be produced, a plurality of processes for producing the sewn product, and parts to be sewn used in each process;

a sewing information generation unit that generates, based on the item information, sewing information including operating conditions of a sewing machine that performs sewing;

an item basic information acquisition unit that acquires item basic information;

a database that accumulates and stores a plurality of templates including a process list in which items related to the process information are arranged in an order in which a plurality of processes are performed, wherein the plurality of templates include the process list into which the process information and sewing machine model information associated with the item basic information are input;

a template calling unit that calls the template corresponding to the item basic information from the database; and a process list information output unit that generates process list information including the process information of the template.

2. The sewing system according to claim 1, comprising:

a database that accumulates and stores correspondence information in which the material information and the operating conditions are associated with each other; and an operating condition search unit that searches the database for the operating conditions corresponding to the material information, wherein the sewing information generation unit generates the sewing information including the operating condition searched by the operating condition search unit.

3. The sewing system according to claim 2, comprising an operating condition editing reception unit capable of receiving an edit to change the operating condition searched by the operating condition search unit, wherein the sewing information generation unit generates the sewing information including the operating conditions edited by the operating condition editing reception unit.

4. The sewing system according to claim 3, comprising a database update unit that updates the correspondence information stored in the database according to the operating conditions edited by the operating condition editing reception unit.

5. The sewing system according to claim 2, comprising:

a feedback information acquisition unit that acquires feedback information output from the sewing machine, when the operating conditions are changed in the sewing machine that performs sewing under the operating conditions based on the sewing information; and a database update unit that updates the correspondence information stored in the database based on the feedback information.

6. The sewing system according to claim 1, wherein the sewing information includes sewing machine information indicating information on a plurality of sewing machines that perform sewing, and the sewing system includes a sewing information distribution unit that divides and distributes the sewing information generated by the sewing information generation unit into sewing information corresponding to each of the sewing machines.

7. The sewing system according to claim 1, wherein the item information includes:

process information including information on a sewn product to be produced, a plurality of processes for producing the sewn product, and parts to be sewn used in each process; and sewing machine model information which is information on a model type of a sewing machine that performs each process.

8. The sewing system according to claim 7, comprising:

an item basic information acquisition unit that acquires item basic information including information on a sewn product to be produced, a fabric to be sewn, and a type of thread used for sewing;

a database that accumulates and stores a plurality of templates including a process list in which items related to the process information are arranged in an order in which a plurality of processes are performed, wherein the plurality of templates include the process list into which the process information and the sewing machine model information associated with the item basic information are input;

a template calling unit that calls the template corresponding to the item basic information from the database; and an item information output unit that generates item information including the process information of the template.

9. The sewing system according to claim 8, comprising a process information editing reception unit capable of receiving an edit to change the process information of the template called by the template calling unit, wherein the item information output unit generates item information including the process information edited by the process information editing reception unit.

10. The sewing system according to claim 8, comprising a sewing information input reception unit capable of receiving an input of material information used for each process in addition to the process information of the template called by the template calling unit, wherein the item information output unit generates the item information including the material information input by the sewing information input reception unit.

11. The sewing system according to claim 1, wherein the item information further includes:

the sewing machine model information includes information on a model type of a sewing machine that performs each process;

graphic information including two-dimensional shape information for sewing; and correspondence table information indicating information on a correspondence table in which the process information, the graphic information, and the material information are associated with each process.

12. The sewing system according to claim 11, wherein the basic information includes information on a sewn product to be produced, a fabric to be sewn, and a type of thread used for sewing.

13. The sewing system according to claim 12, comprising:

a CAD information extraction unit that extracts, based on the information on the part to be sewn used in each of the processes included in the process list information, and, from CAD information including design data including shape data of a workpiece and data of sewing specification, the design data including the shape data of sewing related to the part and the data of sewing specification corresponding to the part, as the graphic information and the material information, respectively;

a correspondence table generation unit that generates correspondence table information indicating information on a correspondence table which includes the process list information and in which the graphic information and the material information extracted from the CAD information are associated with each other for each process in the process list information; and an item information output unit that generates item information including the correspondence table information, and the graphic information and the material information extracted from the CAD information.

14. The sewing system according to claim 13, comprising a coordinate value conversion unit that converts the graphic information into coordinate values for the sewing machine to perform sewing process, if the corresponding sewing machine model is a sewing machine that handles the graphic information in a predetermined process included in the item information, wherein the sewing information generation unit generates sewing information including information on the coordinate values converted by the coordinate value conversion unit.

15. The sewing system according to claim 13, comprising a shirring amount calculation unit that calculates a shirring amount based on the graphic information, if the corresponding sewing machine model is a sewing machine that performs shirring sewing in a predetermined process included in the item information, wherein the sewing information generation unit generates sewing information including information on the shirring amount calculated by the shirring amount calculation unit.

* * * * *